US005552613A

United States Patent [19]

Nishibayashi et al.

[11] Patent Number: 5,552,613

[45] Date of Patent: Sep. 3, 1996

[54] ELECTRON DEVICE

[75] Inventors: Yoshiki Nishibayashi; Tadashi Tomikawa; Shin-ichi Shikata, all of Itami, Japan

[73] Assignee: Sumitomo Electric Industries, Ltd., Japan

[21] Appl. No.: 311,463

[22] Filed: Sep. 22, 1994

[30] Foreign Application Priority Data

Sep. 24, 1993 [JP] Japan ..... 5-238571

[51] Int. Cl.[6] ..... H01J 1/02; H01J 1/14

[52] U.S. Cl. ..... 257/10; 257/77; 313/309; 313/355; 445/50

[58] Field of Search ..... 257/10, 77; 313/309, 313/336, 351, 355; 445/50

[56] References Cited

U.S. PATENT DOCUMENTS 5,138,237 8/1992 Kane et al. .
5,341,063 8/1994 Kumar ..... 257/10

FOREIGN PATENT DOCUMENTS 0523494 1/1993 European Pat. Off. .
93015522 8/1993 WIPO ..... 257/10

OTHER PUBLICATIONS

Geis et al., "Diamond Cold Cathode", IEEE Electron Device Letters, vol. 12, No. 8, Aug. 1, 1991, pp. 456–459.

J. F. Prins, "Bipolar transistor action in ion implanted diamond", Applied Physics Letters, vol. 41, No. 10, Nov. 15, 1982, pp. 950–052.

*Primary Examiner*—Donald L. Monin, Jr.

*Attorney, Agent, or Firm*—Pennie & Edmonds

[57] ABSTRACT

An electron device of the present invention comprises an i-type diamond layer formed on a substrate, and an n-type diamond layer formed on the i-type diamond layer and having a first surface region formed flatly and a second surface region containing an emitter portion, which are set in a vacuum container, in which the emitter portion formed of the n-type diamond has a bottom area 10 or less μm square and projects relative to the first surface region. In the n-type diamond layer, a difference is fine between the conduction band and the vacuum level. Also, since the n-type diamond layer is doped with an n-type dopant in a high concentration, metal conduction is dominant as conduction of electrons. Therefore, setting the temperature of the substrate at a predetermined temperature and generating an electric field near the surface of the emitter portion, electrons are emitted with a high efficiency from the tip portion of the emitter portion into the vacuum. Even though the emitter portion does not have a tip portion formed in a very fine shape, electrons can readily be taken out into the vacuum by the field emission with relatively small field strength. Consequently, the emission current and the current gain increase and the current density in the emitter portion decreases, thus increasing the withstand current or withstand voltage.

32 Claims, 37 Drawing Sheets

Fig. 87

| n-TYPE LAYER MADE OF BULK SINGLE-CRYSTAL DIAMOND | | CURRENT WITH APPLICATION OF 10V (A) |
|---|---|---|
| CONCENTRATION OF NITROGEN ($cm^{-3}$) | CONCENTRATION OF BORON ($cm^{-3}$) | |
| $1\times10^{19}$ | $<1\times10^{16}$ | $1\times10^{-4}$ |
| $3\times10^{19}$ | $<1\times10^{16}$ | $4\times10^{-4}$ |
| $1\times10^{20}$ | $<1\times10^{16}$ | $1\times10^{-3}$ |
| $1\times10^{21}$ | $<1\times10^{16}$ | $5\times10^{-3}$ |

Fig. 88

| n-TYPE LAYER MADE OF SINGLE-CRYSTAL DIAMOND | | CURRENT WITH APPLICATION OF 10V (A) |
|---|---|---|
| CONCENTRATION OF NITROGEN ($cm^{-3}$) | CONCENTRATION OF BORON ($cm^{-3}$) | |
| $1\times10^{18}$ | $<1\times10^{16}$ | $5\times10^{-7}$ |
| $3\times10^{18}$ | $<1\times10^{16}$ | $2\times10^{-6}$ |
| $1\times10^{19}$ | $<1\times10^{16}$ | $1\times10^{-4}$ |
| $3\times10^{19}$ | $<1\times10^{16}$ | $4\times10^{-4}$ |
| $1\times10^{20}$ | $<1\times10^{16}$ | $1\times10^{-3}$ |
| $1\times10^{21}$ | $<1\times10^{16}$ | $5\times10^{-3}$ |
| $1\times10^{18}$ | $1\times10^{16}$ | $5\times10^{-6}$ |
| $1\times10^{18}$ | $2\times10^{17}$ | $2\times10^{-5}$ |
| $1\times10^{18}$ | $9\times10^{17}$ | $5\times10^{-5}$ |
| $1\times10^{18}$ | $3\times10^{18}$ | $1\times10^{-7}$ |
| $1\times10^{17}$ | $2\times10^{16}$ | $5\times10^{-6}$ |
| $1\times10^{17}$ | $9\times10^{16}$ | $9\times10^{-6}$ |

Fig. 89

| n-TYPE LAYER MADE OF POLYCRYSTAL DIAMOND | | CURRENT WITH APPLICATION OF 10V (A) |
|---|---|---|
| CONCENTRATION OF NITROGEN ($cm^{-3}$) | CONCENTRATION OF BORON ($cm^{-3}$) | |
| $1\times10^{18}$ | $<1\times10^{16}$ | $1\times10^{-7}$ |
| $3\times10^{18}$ | $<1\times10^{16}$ | $5\times10^{-7}$ |
| $1\times10^{19}$ | $<1\times10^{16}$ | $3\times10^{-5}$ |
| $3\times10^{19}$ | $<1\times10^{16}$ | $1\times10^{-4}$ |
| $1\times10^{20}$ | $<1\times10^{16}$ | $3\times10^{-4}$ |
| $1\times10^{21}$ | $<1\times10^{16}$ | $1\times10^{-3}$ |

Fig. 90

| n-TYPE LAYER MADE OF BULK SINGLE-CRYSTAL DIAMOND | | CURRENT WITH APPLICATION OF 10V (A) |
|---|---|---|
| CONCENTRATION OF NITROGEN ($cm^{-3}$) | CONCENTRATION OF BORON ($cm^{-3}$) | |
| $1\times10^{19}$ | $<1\times10^{16}$ | $5\times10^{-4}$ |
| $3\times10^{19}$ | $<1\times10^{16}$ | $2\times10^{-3}$ |
| $1\times10^{20}$ | $<1\times10^{16}$ | $5\times10^{-3}$ |
| $1\times10^{21}$ | $<1\times10^{16}$ | $3\times10^{-2}$ |

Fig. 91

| n-TYPE LAYER MADE OF SINGLE-CRYSTAL DIAMOND | | CURRENT WITH APPLICATION OF 10V (A) |
|---|---|---|
| CONCENTRATION OF NITROGEN ($cm^{-3}$) | CONCENTRATION OF BORON ($cm^{-3}$) | |
| $1\times10^{18}$ | $<1\times10^{16}$ | $2\times10^{-6}$ |
| $3\times10^{18}$ | $<1\times10^{16}$ | $1\times10^{-5}$ |
| $1\times10^{19}$ | $<1\times10^{16}$ | $5\times10^{-4}$ |
| $3\times10^{19}$ | $<1\times10^{16}$ | $2\times10^{-3}$ |
| $1\times10^{20}$ | $<1\times10^{16}$ | $5\times10^{-3}$ |
| $1\times10^{21}$ | $<1\times10^{16}$ | $2\times10^{-2}$ |
| $1\times10^{18}$ | $1\times10^{16}$ | $3\times10^{-5}$ |
| $1\times10^{18}$ | $2\times10^{17}$ | $1\times10^{-4}$ |
| $1\times10^{18}$ | $9\times10^{17}$ | $3\times10^{-4}$ |
| $1\times10^{18}$ | $3\times10^{18}$ | $5\times10^{-7}$ |
| $1\times10^{17}$ | $2\times10^{16}$ | $3\times10^{-5}$ |
| $1\times10^{17}$ | $9\times10^{16}$ | $5\times10^{-5}$ |

Fig. 92

| n-TYPE LAYER MADE OF POLYCRYSTAL DIAMOND | | CURRENT WITH APPLICATION OF 10V (A) |
|---|---|---|
| CONCENTRATION OF NITROGEN ($cm^{-3}$) | CONCENTRATION OF BORON ($cm^{-3}$) | |
| $1\times10^{18}$ | $<1\times10^{16}$ | $6\times10^{-7}$ |
| $3\times10^{18}$ | $<1\times10^{16}$ | $3\times10^{-6}$ |
| $1\times10^{19}$ | $<1\times10^{16}$ | $2\times10^{-4}$ |
| $3\times10^{19}$ | $<1\times10^{16}$ | $5\times10^{-4}$ |
| $1\times10^{20}$ | $<1\times10^{16}$ | $2\times10^{-3}$ |
| $1\times10^{21}$ | $<1\times10^{16}$ | $6\times10^{-3}$ |

Fig. 93

| n-TYPE LAYER MADE OF SINGLE-CRYSTAL DIAMOND | | CURRENT WITH APPLICATION OF 10V (A) |
|---|---|---|
| CONCENTRATION OF NITROGEN ($cm^{-3}$) | CONCENTRATION OF BORON ($cm^{-3}$) | |
| $1\times10^{18}$ | $<1\times10^{16}$ | $4\times10^{-7}$ |
| $3\times10^{18}$ | $<1\times10^{16}$ | $1\times10^{-6}$ |
| $1\times10^{19}$ | $<1\times10^{16}$ | $8\times10^{-5}$ |
| $3\times10^{19}$ | $<1\times10^{16}$ | $2\times10^{-4}$ |
| $1\times10^{20}$ | $<1\times10^{16}$ | $9\times10^{-4}$ |
| $1\times10^{21}$ | $<1\times10^{16}$ | $4\times10^{-3}$ |
| $1\times10^{18}$ | $1\times10^{16}$ | $4\times10^{-6}$ |
| $1\times10^{18}$ | $2\times10^{17}$ | $1\times10^{-5}$ |
| $1\times10^{18}$ | $9\times10^{17}$ | $3\times10^{-5}$ |
| $1\times10^{18}$ | $3\times10^{18}$ | $8\times10^{-8}$ |
| $1\times10^{17}$ | $2\times10^{16}$ | $4\times10^{-6}$ |
| $1\times10^{17}$ | $9\times10^{16}$ | $7\times10^{-6}$ |

Fig. 94

| n-TYPE LAYER MADE OF POLYCRYSTAL DIAMOND | | CURRENT WITH APPLICATION OF 10V (A) |
|---|---|---|
| CONCENTRATION OF NITROGEN ($cm^{-3}$) | CONCENTRATION OF BORON ($cm^{-3}$) | |
| $1\times10^{18}$ | $<1\times10^{16}$ | $6\times10^{-8}$ |
| $3\times10^{18}$ | $<1\times10^{16}$ | $3\times10^{-7}$ |
| $1\times10^{19}$ | $<1\times10^{16}$ | $1\times10^{-5}$ |
| $3\times10^{19}$ | $<1\times10^{16}$ | $5\times10^{-5}$ |
| $1\times10^{20}$ | $<1\times10^{16}$ | $1\times10^{-4}$ |
| $1\times10^{21}$ | $<1\times10^{16}$ | $7\times10^{-4}$ |

Fig. 95

| n-TYPE LAYER MADE OF SINGLE-CRYSTAL DIAMOND | | CURRENT WITH APPLICATION OF 10V (A) |
|---|---|---|
| CONCENTRATION OF NITROGEN ($cm^{-3}$) | CONCENTRATION OF BORON ($cm^{-3}$) | |
| $1\times10^{18}$ | $<1\times10^{16}$ | $1\times10^{-6}$ |
| $3\times10^{18}$ | $<1\times10^{16}$ | $8\times10^{-6}$ |
| $1\times10^{19}$ | $<1\times10^{16}$ | $4\times10^{-4}$ |
| $3\times10^{19}$ | $<1\times10^{16}$ | $1\times10^{-3}$ |
| $1\times10^{20}$ | $<1\times10^{16}$ | $3\times10^{-3}$ |
| $1\times10^{21}$ | $<1\times10^{16}$ | $1\times10^{-2}$ |
| $1\times10^{18}$ | $1\times10^{16}$ | $2\times10^{-5}$ |
| $1\times10^{18}$ | $2\times10^{17}$ | $6\times10^{-5}$ |
| $1\times10^{18}$ | $9\times10^{17}$ | $2\times10^{-4}$ |
| $1\times10^{18}$ | $3\times10^{18}$ | $3\times10^{-7}$ |
| $1\times10^{17}$ | $2\times10^{16}$ | $1\times10^{-5}$ |
| $1\times10^{17}$ | $9\times10^{16}$ | $4\times10^{-5}$ |

Fig. 96

| n-TYPE LAYER MADE OF POLYCRYSTAL DIAMOND | | CURRENT WITH APPLICATION OF 10V (A) |
|---|---|---|
| CONCENTRATION OF NITROGEN ($cm^{-3}$) | CONCENTRATION OF BORON ($cm^{-3}$) | |
| $1\times10^{18}$ | $<1\times10^{16}$ | $2\times10^{-7}$ |
| $3\times10^{18}$ | $<1\times10^{16}$ | $1\times10^{-6}$ |
| $1\times10^{19}$ | $<1\times10^{16}$ | $8\times10^{-5}$ |
| $3\times10^{19}$ | $<1\times10^{16}$ | $2\times10^{-4}$ |
| $1\times10^{20}$ | $<1\times10^{16}$ | $5\times10^{-4}$ |
| $1\times10^{21}$ | $<1\times10^{16}$ | $2\times10^{-3}$ |

ELECTRON DEVICE

BACKGROUND OF THE INVENTION

1. Field of the Invention

The present invention relates to an electron device utilized in a cold-cathode device functioning as an emitter of electron beam in a micro vacuum tube, a light-emitting device array, etc.

2. Related Background Art

Conventional semiconductor devices had such drawbacks that electron mobility is as low as 1/1000 times that in vacuum and that reliability is low against radiation. On the other hand, conventional vacuum tubes had no such drawbacks. It has thus been being considered that ICs having the performance of the conventional vacuum tubes could be produced by fabricating the micro vacuum tube using the micromachining techniques fostered in the field of Si semiconductor devices. Accordingly, the micro vacuum tube overcoming the drawbacks of the conventional semiconductor devices has been vigorously studied and developed effectively using the fabrication technology of Si semiconductor devices.

Studied in connection with such a trend is an emitter of electron beam used in the micro vacuum tube, the light-emitting device array, etc. The conventional vacuum tubes, however, had a drawback of needing a long standby time of several minutes between start of operation and a state of being ready for use. Overcoming it, electron devices such as the micro vacuum tube considerably shortened the standby time by such an arrangement that the tip of an emitter portion is micromachined like a very acute needle by the fabrication technology of Si semiconductor devices so that electrons can be emitted by the field emission.

Also, it comes to recent attention that diamond is used as a material for the electron devices. Diamond has the thermal conductivity of 20 W/cm·K, which is maximum among other materials for the electron devices and which is 10 or more times larger than that of Si. Since diamond is thus excellent in heat radiation for a large current density, electron devices operable at high temperatures can be produced using diamond as a constituent material.

Further, diamond is an insulator in an undoped state, which has a high dielectric strength, a small dielectric constant of 5.5, and a high breakdown voltage of $5\times10^6$ V/cm. Thus, diamond is a potential material for electron devices for high power used in the high-frequency region.

To produce low-resistance diamond, Geis et al. at MIT formed an n-type diamond semiconductor by implantation of carbon.

This prior art technology is described in detail, for example, in "Appl. Phys. Lett., vol. 41, no. 10, pp 950–952, November 1982."

SUMMARY OF THE INVENTION

The above conventional electron device uses such materials as a single crystal silicon substrate and a metal having a high melting point together in order to readily produce the emitter portion by the micromachining. The emitter portion made of such materials can have, however, the emission current of at most about 100 μA per device, and a mutual conductance gm evaluated with a transistor consisting of the emitter portion is no more than the μS order. These values are very small as compared with the emission current and the mutual conductance of about mA and mS orders, respectively, required for normal semiconductor devices.

In the above conventional electron device, the tip of the emitter portion is formed to be very thin in order to keep the emitter portion operated by a very low voltage. Then, the emitter portion has a great current density during operation, thus lowering a withstand voltage or withstand current.

Further, the above conventional n-type diamond semiconductor is formed by implantation of carbon, so that the donor levels measured to the conduction band are very high, which is against efficient emission of electrons.

The present invention has been accomplished taking the above problems into consideration, and an object of the invention is, therefore, to provide an electron device which has an increased emission current, an increased current gain, and an increased withstand voltage or withstand current, by applying the micro electron technology to diamond so as to reduce the current density in the emitter portion during operation.

A first electron device according to the present invention, achieving the above object, comprises an i-type diamond layer formed on a substrate, and an n-type diamond layer formed on the i-type diamond layer and having a first surface region and a second surface region, which are set in a vacuum container, wherein the first surface region is formed as being flat and the second surface region is formed to have an emitter portion having a bottom area of not more than a 10 μm square and formed of the n-type diamond layer, the emitter portion projecting relative to the first surface region.

A second electron device according to the present invention, achieving the above object, comprises an i-type substrate formed to have a first surface region and a second surface region, an i-type diamond layer formed in the second surface region, an n-type diamond layer formed on the i-type diamond layer, and a wiring layer formed in the first surface region so as to be connected with the n-type diamond layer, which are set in a vacuum container, wherein the first surface region is formed as being flat and the second surface region is formed to have an emitter portion having a bottom area of not more than a 10 μm square and formed of the i-type diamond layer and the n-type diamond layer, the emitter portion projecting relative to the first surface region.

A third electron device according to the present invention, achieving the above object, comprises an i-type diamond layer formed on a substrate, and at least one n-type diamond layer formed on the i-type diamond layer and having a first surface region and a plurality of second surface regions, which are set in a vacuum container, wherein the first surface region is formed as being flat and the plurality of second surface regions are formed to have a plurality of emitter portions each having a bottom area of not more than a 10 μm square and being formed of the n-type diamond layer, the emitter portions being arranged in a two-dimensional array so as to project relative to the first surface region.

Further, a fourth electron device according to the present invention, achieving the above object, comprises an i-type substrate formed to have a first surface region and a plurality of second surface regions, a plurality of i-type diamond layers formed in the plurality of respective second surface regions, a plurality of n-type diamond layers formed on the plurality of respective i-type diamond layers, and at least one wiring layer formed in the first surface region so as to be connected with the n-type diamond layers, which are set in a vacuum container, wherein the first surface region is formed as being flat and the plurality of second surface regions are formed to have a plurality of emitter portions each having a bottom area of not more than a 10 μm square and formed of the i-type diamond layer and the n-type diamond layer, the emitter portions projecting relative to the first surface region.

Here, an embodiment may be so arranged that an insulting layer and an electrode layer are successively layered further in the first surface region.

In an embodiment, the emitter portion may be formed with a height 1/10 or more of the minimum width in the second surface region with respect to the first surface region.

An n-type dopant in the n-type diamond layer may be nitrogen. Specifically, a dopant concentration of nitrogen in the n-type diamond layer is preferably not less than $1\times10^{19}$ $cm^{-3}$. The dopant concentration of nitrogen in the n-type diamond layer is preferably more than a dopant concentration of boron and not more than 100 times the dopant concentration of boron. The dopant concentration of nitrogen in the n-type diamond layer is more preferably more than the dopant concentration of boron and not more than 10 times the dopant concentration of boron.

In the first and third electron devices according to the present invention, the n-type diamond layer is formed on the i-type diamond layer while having a flat surface as the first surface region, and the one emitter portion or the plurality of emitter portions each having the bottom area of not more than the 10 μm square are formed in the second surface region(s) so as to project relative to the first surface region.

In the second and fourth electron devices according to the present invention, the i-type substrate is formed to have the flat surface as the first surface region, and the second surface region in the i-type substrate has the one emitter portion or the plurality of emitter portions in the lamination structure of the i-type diamond layer and the n-type diamond layer and with the bottom area of not more than the 10 μm square, formed so as to project relative to the first surface region.

Diamond forming the n-type diamond layer has a value of electron affinity which is very close to zero, whereby a difference is fine between the conduction band and the vacuum level.

The present inventors presumed that electrons could be readily taken out into the vacuum by supplying a current thereof in diamond. Then, the present inventors verified that electrons were emitted with a very high efficiency into the vacuum by the field emission with the n-type diamond layer doped with nitrogen as the n-type dopant in a high concentration or further doped with boron in accordance with the dopant concentration of nitrogen. Since the n-type diamond layer is doped with the n-type dopant in a high concentration, the donor levels are degenerated near the conduction band, so that metal conduction is dominant as conduction of electrons.

Thus, increasing the temperature of the substrate to about 300° to about 600° C., generating an electric field near the surface of the emitter portion, and supplying an electric current to the n-type diamond layer or the wiring layer connected with the emitter portion, electrons are emitted with a high efficiency from the tip of the emitter portion into the vacuum. Where the dopant concentration of nitrogen in the n-type diamond layer is high enough, electrons can be emitted with a high efficiency from the tip of the emitter portion by the field emission even if the temperature of the substrate is about the room temperature.

Thus, if the emitter portion made of n-type diamond has the bottom area of not more than the 10 μm square in the second surface region and projects relative to the first surface region even though the tip thereof is not very fine, electrons can be readily taken out into the vacuum by the field emission with a relatively small field strength.

Accordingly, the emission current and the current gain increase and the current density in the emitter portion decreases, thus increasing the withstand current or withstand voltage.

If the insulating layer and electrode layer are successively layered further in the first surface region in the i-type diamond layer or the i-type substrate, electrons emitted from the emitter portion are captured by the electrode layer to be detected.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 87 is a drawing to show changes in emission current against dopant concentrations of nitrogen and boron where an n-type layer of the electron device of FIG.. FIG. 1 is made of bulk single crystal diamond synthesized under a high pressure;

FIG. 88 is a drawing to show changes in emission current against dopant concentrations of nitrogen and boron where the n-type layer of the electron device of FIG. 1 is made of single crystal diamond (an epitaxial layer) vapor-phase-synthesized on a substrate 1 made of single crystal diamond;

FIG. 89 is a drawing to show changes in emission current against dopant concentrations of nitrogen and boron where the n-type layer of the electron device of FIG. 1 is made of polycrystal diamond vapor-phase-synthesized on the substrate 1 made of silicon;

FIG. 90 is a drawing to show changes in emission current against dopant concentrations of nitrogen and boron where an n-type layer of the electron device of FIG. 18 is made of bulk single crystal diamond synthesized under a high pressure;

FIG. 91 is a drawing to show changes in emission current against dopant concentrations of nitrogen and boron where the n-type layer of the electron device of FIG. 18 is made of single crystal diamond (an epitaxial layer) vapor-phase-synthesized on a substrate 1 made of single crystal diamond;

FIG. 92 is a drawing to show changes in emission current against dopant concentrations of nitrogen and boron where the n-type layer of the electron device of FIG. 18 is made of polycrystal diamond vapor-phase-synthesized on the substrate 1 made of silicon;

FIG. 93 is a drawing to show changes in emission current against dopant concentrations of nitrogen and boron where an n-type layer of the electron device of FIG. 41 is made of single crystal diamond (an epitaxial layer) vapor-phase-synthesized on a substrate 1 made of single crystal diamond;

FIG. 94 is a drawing to show changes in emission current against dopant concentrations of nitrogen and boron where the n-type layer of the electron device of FIG. 41 is made of polycrystal diamond vapor-phase-synthesized on the substrate 1 made of silicon;

FIG. 95 is a drawing to show changes in emission current against dopant concentrations of nitrogen and boron where an n-type layer of the electron device of FIG. 61 is made of single crystal diamond (epitaxial layer) vapor-phase-synthesized on a substrate 1 made of single crystal diamond; and FIG. 96 is a drawing to show changes in emission current against dopant concentrations of nitrogen and boron where the n-type layer of the electron device of FIG. 61 is made of polycrystal diamond vapor-phase-synthesized on the substrate 1 made of silicon.

DESCRIPTION OF THE PREFERRED EMBODIMENTS

Figure 1:
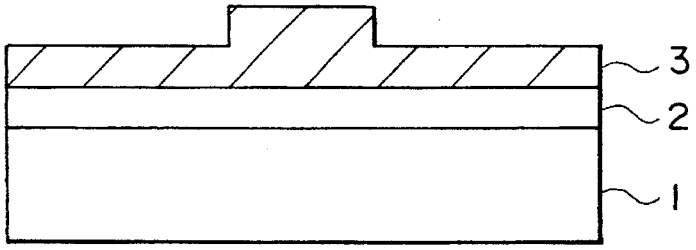
FIG. 1 is a cross-sectional view to show the structure of the first embodiment of an electron device according to the present invention.

The constitution and operation of embodiments according to the present invention will be described with reference to FIG. 1 to FIG. 86. In the description of the drawings, same elements will be denoted by same reference numerals and redundant description will be omitted. It should be noted that the dimensions in the drawing do not always coincide with those in the description.

First Embodiment

FIG. 1 shows the structure of the first embodiment of the electron device according to the present invention. An i-type layer 2 and an n-type layer 3 are successively layered on a substrate 1. The n-type layer 3 has a flat surface, and a protruded emitter portion is formed in a predetermined region of the n-type layer 3 so as to project from the flat surface. The emitter portion has a bottom area in the range 1 to 10 μm square and a top area in the range 1 to 10 μm square, substantially same as the bottom area, and a height between the bottom and the top is 1/10 or more of the minimum width in the bottom.

Here, the substrate 1 is an insulator substrate made of an artificial single crystal diamond (of Ib type) synthesized under a high pressure, or a semiconductor substrate made of silicon. Also, the i-type layer 2 is made of a high-resistance diamond having the layer thickness of about 2 μm. Further, the n-type layer 3 is made of a low-resistance diamond having the layer thickness of about 5 μm.

The n-type layer 3 is doped with nitrogen in a high concentration, so that a dopant concentration thereof $C_N$ is not less than $1\times10^{19}$ $cm^{-3}$. Instead thereof, the n-type layer 3 may be doped with nitrogen and boron so that a dopant concentration $C_N$ of nitrogen and a dopant concentration of boron $C_B$ satisfy the relation of $100C_B \geqq C_N > C_B$, more preferably the relation of $10C_B \geqq C_N > C_B$.

The i-type layer 2 is actually doped with little nitrogen or boron, so that the dopant concentrations of nitrogen and boron are less than the dopant concentration of nitrogen in the n-type layer 3.

The operation of the first embodiment is next described.

Since diamond forming the n-type layer 3 has an electron affinity very close to zero, the difference is fine between the conduction band and the vacuum level. The n-type layer 3 is doped with nitrogen as an n-type dopant in a high concentration or further with boron according to the dopant concentration of nitrogen, so that the donor levels are degenerated near the conduction band, thus making the metal conduction dominant as conduction of electrons.

Then, increasing the temperature of the substrate up to about 300° to about 600° C., generating an electric field near the surface of the emitter portion, and supplying an electric current to the n-type layer 3, electrons are emitted with a high efficiency from the tip portion of the emitter portion into the vacuum. When the dopant concentration of nitrogen is high enough in the n-type layer 3, electrons can be taken out with a high efficiency from the tip portion of the emitter portion by the field emission even at the temperature of the substrate near the room temperature.

Therefore, even though the emitter portion formed of the n-type layer 3 does not have a very fine tip portion, electrons can readily be taken out into the vacuum by the field emission with small field strength. Accordingly, the emission current and the current gain increase and the current density in the emitter portion decreases, thus increasing the withstand current or withstand voltage.

FIG. 2 to FIG. 5 show a sequence of steps for producing the above first embodiment.

Figure 2:
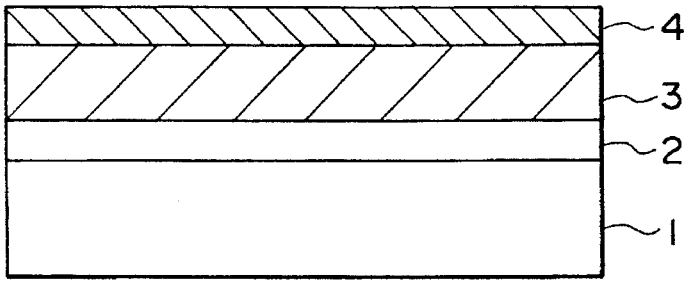
FIG. 2 to FIG. 5 are cross-sectional views to show a sequence of steps for producing the electron device of FIG. 1.

First, the i-type layer 2, the n-type layer 3, and a mask layer 4 are successively layered on the substrate 1 by the microwave plasma CVD method. Here, the i-type layer 2 is formed in such a manner that microwaves with power 300 W are applied to a mixture gas of $H_2$ flowing at a flow rate of 100 sccm and $CH_4$ flowing at a flow rate of 6 sccm to effect high-frequency discharge and then to effect vapor deposition on the substrate 1 kept at a temperature of about 800° C. under a pressure of 40 Torr. The n-type layer 3 is formed in such a manner that under the same fabrication conditions as the i-type layer 2 except that the mixture gas further includes $NH_3$ flowing at a flow rate of 5 sccm as a dopant gas, vapor deposition is effected on the i-type layer 2. The mask layer 4 is formed by vapor-depositing Al or $SiO_2$ on the n-type layer 3 (FIG. 2).

Figure 3:
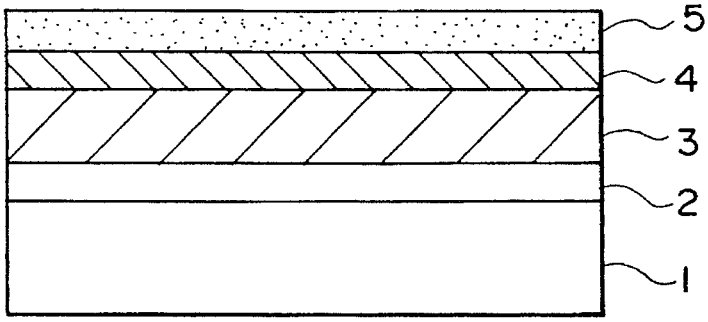

Next, a photoresist layer 5 is formed on the mask layer 4 by the ordinary spin coating method (FIG. 3).

Figure 4:
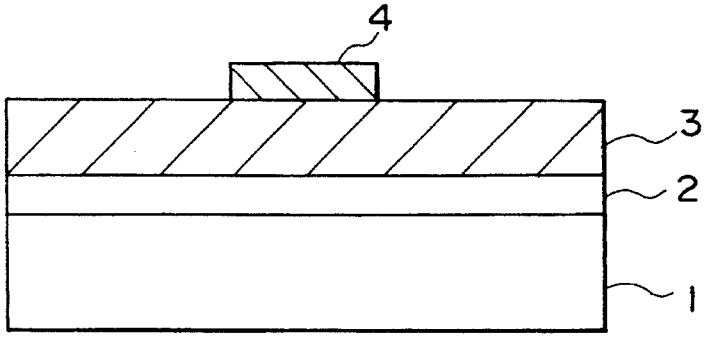

Then a predetermined pattern is formed in the photoresist layer 5, based on the ordinary photolithography technology. Subsequently, the mask layer 4 is patterned in accordance with the pattern of the resist layer 5, based on the ordinary etching technology, and thereafter the resist layer 5 is removed (FIG. 4).

Figure 5:
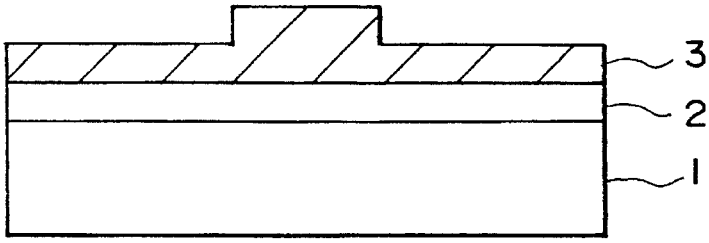

Then the n-type layer 3 is patterned in accordance with the pattern of the mask layer 4 by the dry etching method using Ar gas containing 1% by volume of $O_2$, and thereafter the mask layer 4 is removed. Here, the peripheral region of the n-type layer 3 exposed out from the pattern of the mask layer 4 is etched to form a flat surface, so that the emitter portion is formed in the inner region of the n-type layer 3 covered with the pattern of the mask layer 4 so as to project with respect to the surface of the peripheral region (FIG. 5).

Figure 6:
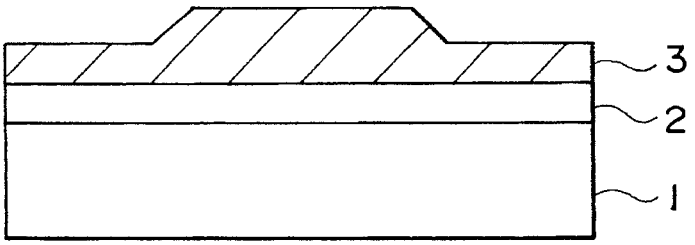
FIG. 6 is a cross-sectional view to show the structure of a first modification of the electron device of FIG. 1.
Figure 7:
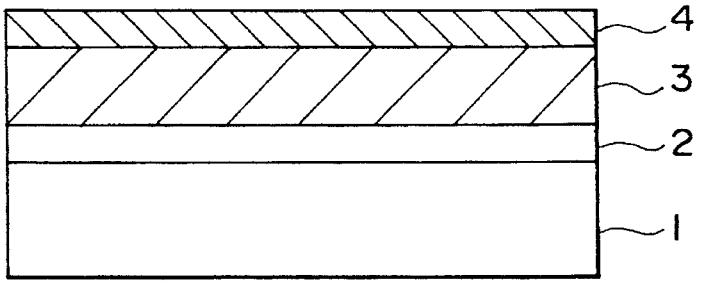
FIG. 7 to FIG. 10 are cross-sectional views to show a sequence of steps for producing the electron device of FIG. 6.
Figure 8:
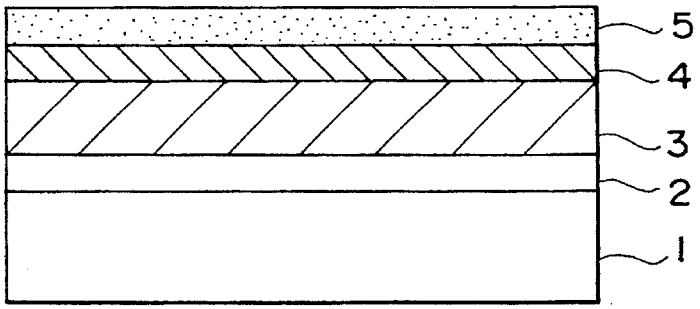
Figure 9:
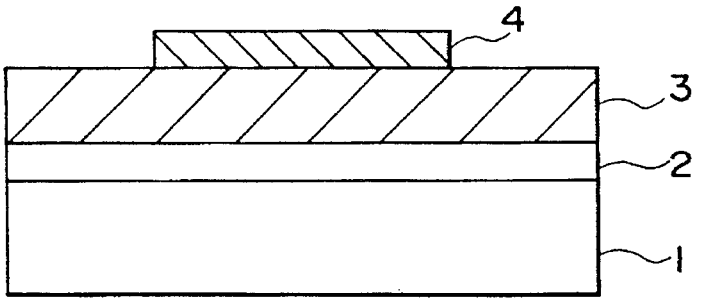
Figure 10:
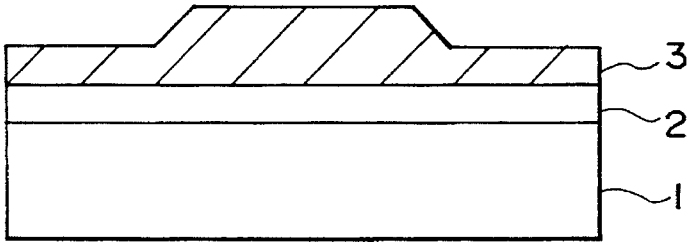

FIG. 6 shows the structure of a first modification of the above first embodiment. The first modification is constructed substantially in the same structure as the first embodiment except that the emitter portion has the bottom area in the range 1 to 10 μm square and the top area in the range 0.5 to 5 μm square, which is about a quarter of the bottom area, and that the height between the bottom and the top is 1/10 or more of the minimum width in the bottom. The operation of the thus constructed modification is substantially the same as that of the first embodiment.

FIG. 7 to FIG. 10 show a sequence of steps for producing the above first modification. The first modification is produced substantially in the same manner as the first embodiment except that the pattern of the mask layer 4 covering the n-type layer 3 and the time for etching the n-type layer 3 need to be adjusted to define the top area of the emitter portion in the range 0.5 to 5 μm square.

Figure 11:
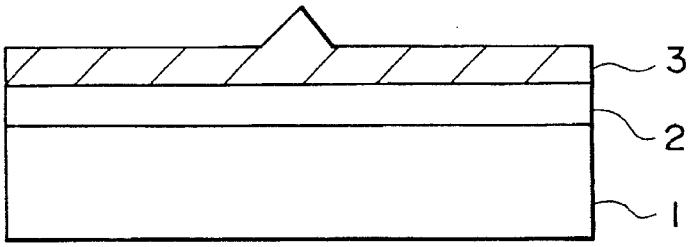
FIG. 11 is a cross-sectional view to show the structure of a second modification of the electron device of FIG. 1.
Figure 12:
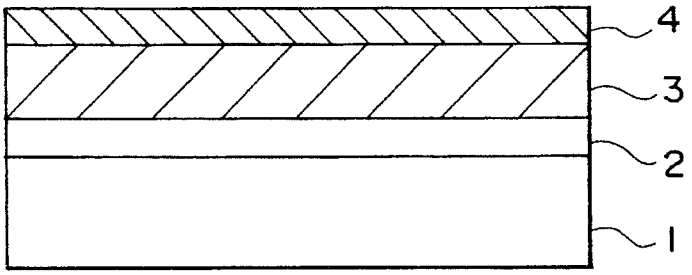
FIG. 12 to FIG. 15 are cross-sectional views to show a sequence of steps for producing the electron device of FIG. 11.
Figure 13:
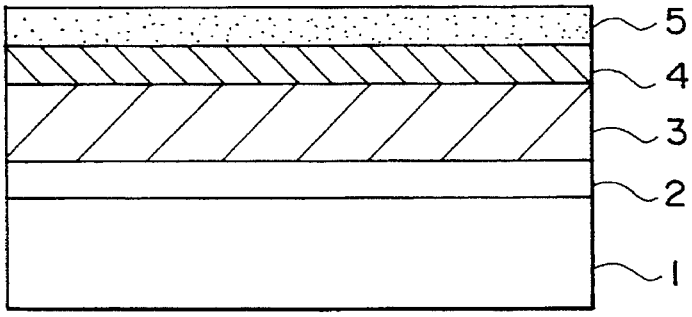
Figure 14:
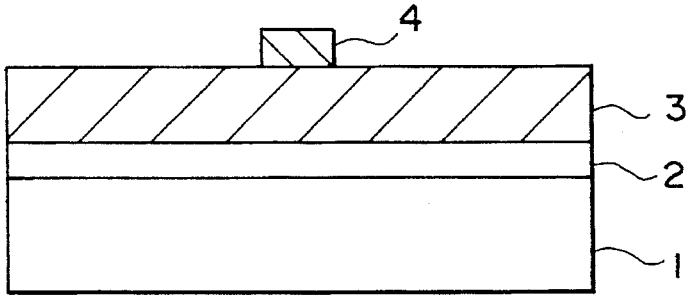
Figure 15:
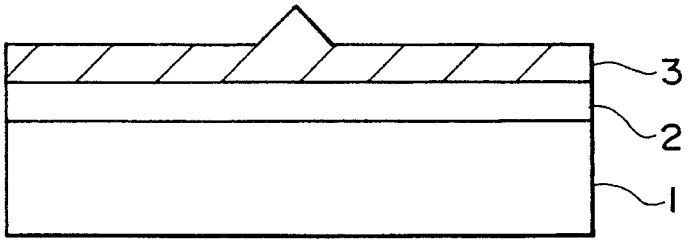

FIG. 11 shows the structure of a second modification of the above first embodiment. The present modification is constructed substantially in the same structure as the first embodiment except that the emitter portion has the bottom area in the range 1 to 10 μm square and the top area in the range 0.1 or less μm square, which is 1/100 or less of the bottom area, and that the height between the bottom and the top is 1/10 or more of the minimum width in the bottom. The operation of the thus constructed modification is substantially the same as that of the first embodiment.

FIG. 12 to FIG. 15 show a sequence of steps for producing the above second modification. The present modification is produced substantially in the same manner as the first embodiment except that the pattern of the mask layer 4 covering the n-type layer 3 and the time for etching the n-type layer 3 need to be adjusted to define the top area of the emitter portion as being not more than 0.1 μm square.

Figure 16:
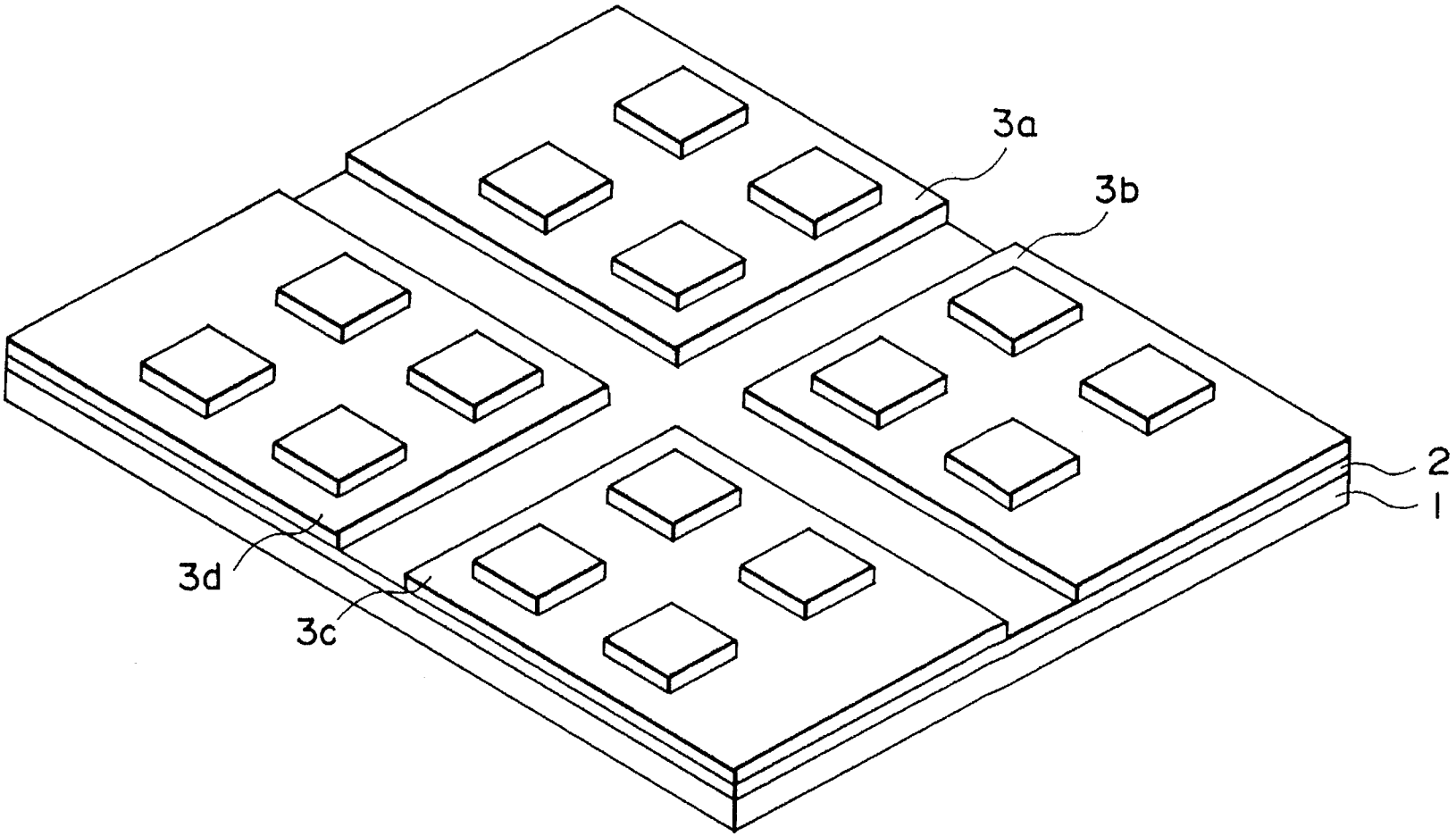
FIG. 16 is a plan view to show the structure of a third modification of the electron device of FIG. 1.

FIG. 16 shows the structure of a third modification of the first embodiment. In the present modification, a plurality of the first embodiments are arranged in array on the i-type layer 2. In more detail, n-type layers 3*a* to 3*d* are arranged as separate from each other on the i-type layer 2. Each of the n-type layers 3*a* to 3*d* has a flat surface, and four protruded emitter portions are formed in a two-dimensional array in four predetermined regions so as to project from the flat surface. Each emitter portion is constructed substantially in the same structure as that of the first embodiment. The n-type layers 3*a* to 3*d* are electrically insulated from each other by the i-type layer 2.

The operation of the third modification is next described.

Increasing the temperature of the substrate up to about 300° to about 600° C., generating an electric field near the surface of the emitter portions, and supplying an electric current to either one selected from the n-type layers 3*a* to 3*d*, electrons are emitted with a high efficiency into the vacuum from the tip portion of each emitter portion formed in the selected n-type layer. When the dopant concentration of nitrogen is high enough in the n-type layers 3*a* to 3*d*, electrons can be taken out with a high efficiency from the tip portion of each emitter portion by the field emission even at the temperature of the substrate near the room temperature.

Figure 17:
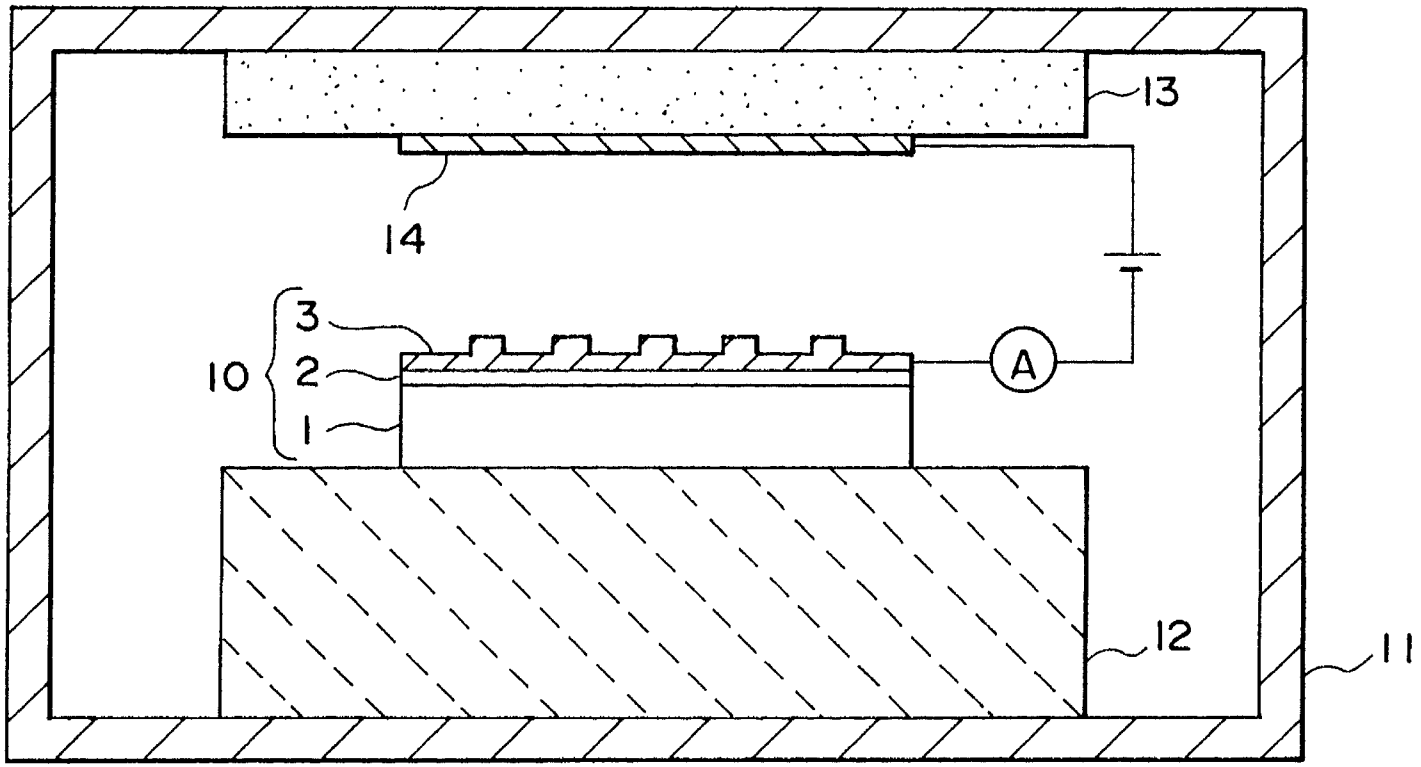
FIG. 17 is a partial cross-sectional view to show the structure of an experimental apparatus of the electron device of FIG. 1.

FIG. 17 shows the structure of an experimental apparatus according to the above first embodiment. The inside of a vacuum chamber 11 is kept substantially in vacuum. A heating holder 12 is set on the bottom of the vacuum chamber 11, and an anode electrode plate 14 is set on a setting portion 13 located above the heating holder 12. An electron device 10 is set on the heating holder 12, so that it is held at a clearance of distance 0.1 to 5 mm to the anode electrode plate 14.

There are a power source and a current meter connected in series between the anode electrode plate 14 and the n-type layer 3 to generate an electric field between the anode electrode plate 14 and the electron device 10. Electrons emitted from the electron device 10 are captured by the anode electrode plate 14 and then are detected by the current meter as an emission current from the electron device 10.

Here, the surface of the electron device 10 has a plurality of emitter portions formed of the n-type layer 3 and arranged at intervals of 5 to 50 μm in the two-dimensional array on the 1 mm-square substrate 1. The emitter portions are formed in the same manner as the first embodiment except that the dopant concentrations of nitrogen and boron in the n-type layer 3 are changed in a certain range. Also, the anode electrode plate 14 is made of a plate metal of tungsten.

The heating holder was first activated to set the substrate 1 at a temperature in the range of 20° to 600° C. The power supply was then activated to apply a voltage of 10 V between the electron device 10 and the anode electrode plate 14, generating an electric field. A flow of electrons emitted from the electron device 10 because of the generated electric field was measured by the current meter.

FIG. 87 shows changes of the emission current against the dopant concentrations of nitrogen and boron where the n-type layer 3 is made of bulk single crystal diamond synthesized under a high pressure.

FIG. 88 shows changes of the emission current against the dopant concentrations of nitrogen and boron where the n-type layer 3 is made of single crystal diamond (an epitaxial layer) vapor-phase-synthesized on the substrate 1 made of single crystal diamond.

FIG. 89 shows changes of the emission current against the dopant concentrations of nitrogen and boron where the n-type layer 3 is made of polycrystal diamond vapor-phase-synthesized on the substrate 1 made of silicon.

It is seen from the above results that a sufficient emission current can be attained when the dopant concentration $C_N$ of nitrogen in the n-type layer 3 is not less than $1\times10^{19}$ $cm^{-3}$. When the dopant concentrations $C_N$, $C_B$ of nitrogen and boron in the n-type layer 3 satisfy the relation of $100C_B \geqq C_N > C_B$, more preferably the relation of $10C_B \geqq C_N > C_B$, a sufficient emission current can also be obtained.

Second Embodiment

Figure 18:
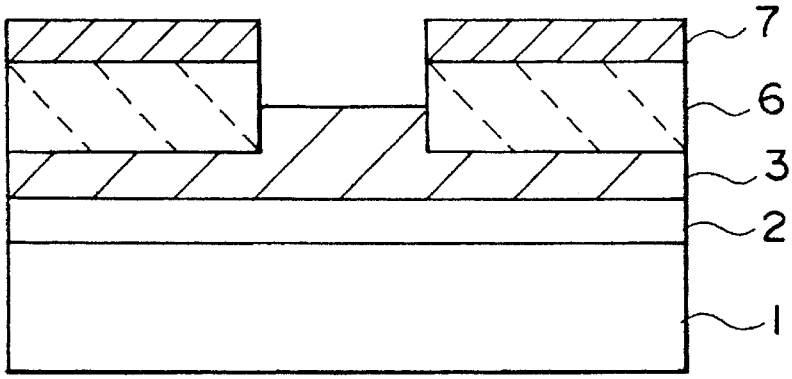
FIG. 18 is a cross-sectional view to show the structure of the second embodiment of the electron device according to the present invention.

FIG. 18 shows the structure of the second embodiment of the electron device according to the present invention. There are an i-type layer 2, an n-type layer 3, an insulating layer 6, and an anode electrode layer 7 successively layered on a substrate 1. The n-type layer 3 has a flat surface and a protruded emitter portion is formed in a predetermined region thereof so as to project from the flat surface. The emitter portion has the bottom area in the range 1 to 10 μm square and the top area in the range 1 to 10 μm square, which is substantially the same as the bottom area, and the height between the bottom and the top is 1/10 or more of the minimum width in the bottom.

The insulating layer 6 is formed on the n-type layer 3 located in the peripheral region beside the emitter portion. The anode electrode layer 7 is formed on the insulating layer 6. Thus, the top of the emitter portion is exposed to the outside.

Here, the substrate 1, the i-type layer 2, and the n-type layer 3 are formed substantially in the same manner as in the above first embodiment. Here, the insulating layer 6 is formed by vapor deposition of $SiO_2$. Also, the anode electrode layer 7 is formed by vapor deposition of a metal having good conductivity.

The operation of the thus constructed embodiment is substantially the same as that of the first embodiment. Here, since the anode electrode layer 7 is formed above the n-type layer 3 located in the peripheral region beside the emitter portion, electrons emitted from the emitter portion are captured by the anode electrode layer 7 to be detected.

FIG. 19 to FIG. 24 show a sequence of steps for producing the second embodiment.

Figure 19:
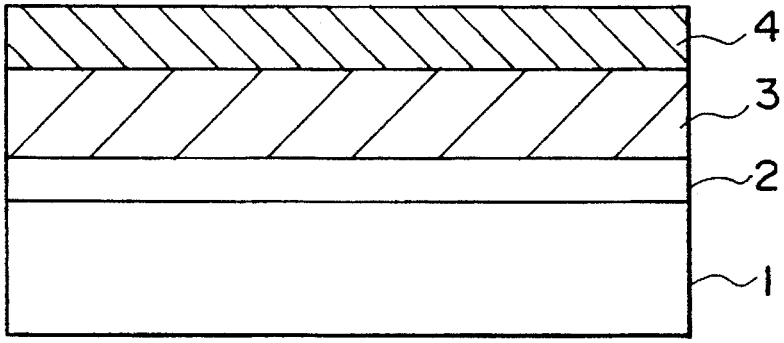
FIG. 19 to FIG. 24 are cross-sectional views to show a sequence of steps for producing the electron device of FIG. 18.

First, the i-type layer 2, the n-type layer 3, and the mask layer 4 are successively layered on the substrate 1 by the microwave plasma CVD method. Here, the i-type layer 2, the n-type layer 3, and the mask layer 4 are formed under the substantially same production conditions as in the first embodiment (FIG. 19).

Figure 20:
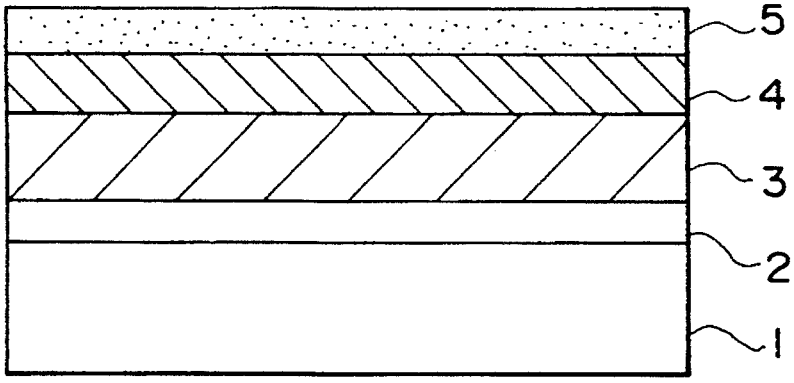

Next, a photoresist layer 5 is formed on the mask layer 4 by the ordinary spin coating method (FIG. 20).

Figure 21:
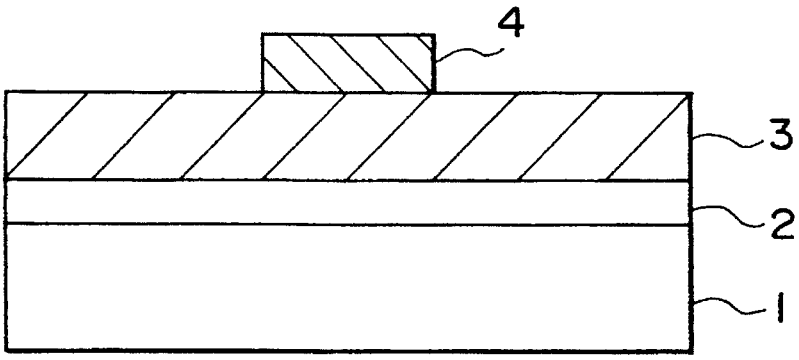

Then a predetermined pattern is formed in the resist layer 5, based on the ordinary photolithography technology. Subsequently, the mask layer 4 is patterned in accordance with the pattern of the resist layer 5, based on the ordinary etching technology, and thereafter the resist layer 5 is removed (FIG. 21).

Figure 22:
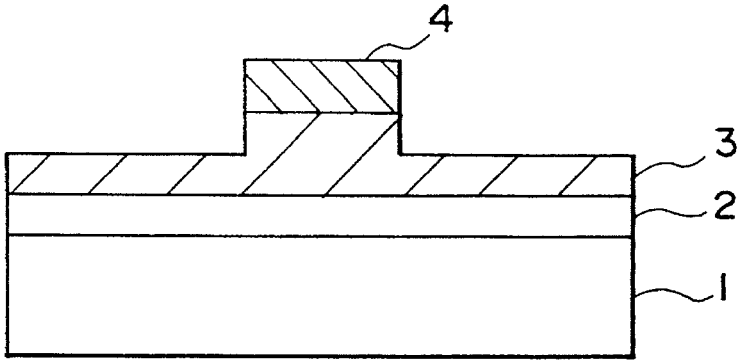

Then the n-type layer 3 is patterned in accordance with the pattern of the mask layer 4 by the dry etching method using Ar gas containing 1% by volume of $O_2$. Here, the peripheral region of the n-type layer 3 exposed out from the pattern of the mask layer 4 is etched to form a flat surface, so that the emitter portion projecting from the surface of the peripheral region is formed in the inner region of the n-type layer 3 covered with the pattern of the mask layer 4 (FIG. 22).

Figure 23:
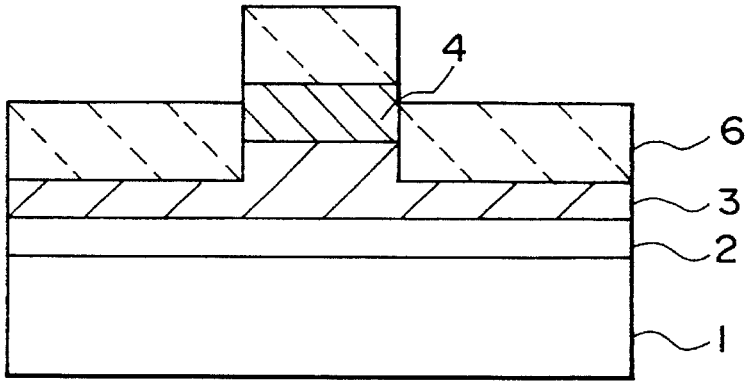

Then $SiO_2$ is vapor-deposited on the n-type layer 3 and the mask layer 4 to form the insulating layer 6 (FIG. 23).

Figure 24:
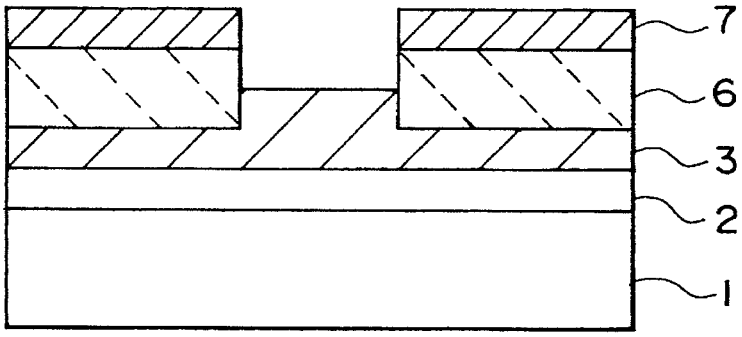

Next, a metal is vapor-deposited on the insulating layer 6 located in the peripheral region beside the emitter portion to form the anode electrode layer 7, and thereafter the mask layer 4 and the insulating layer 6 located over the emitter portion are removed (FIG. 24).

Figure 25:
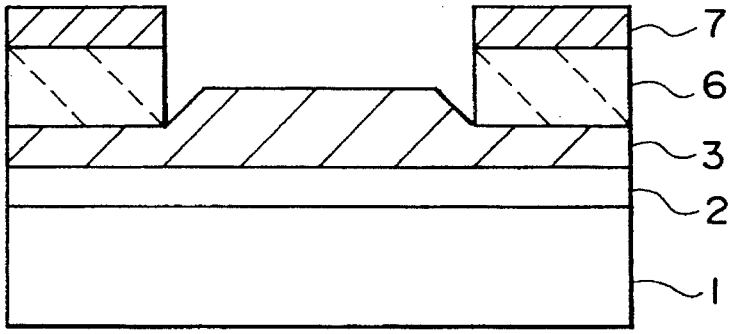
FIG. 25 is a cross-sectional view to show the structure of a first modification of the electron device of FIG. 18.
Figure 26:
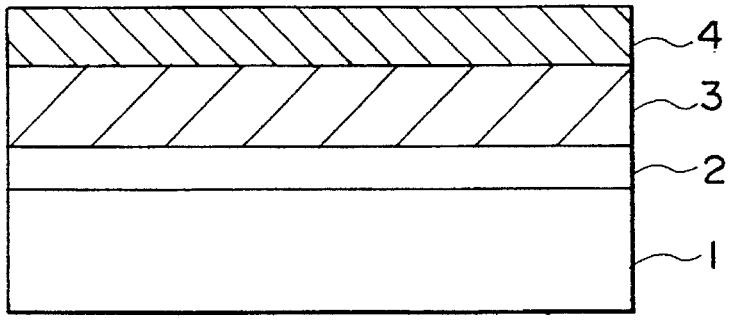
FIG. 26 to FIG. 31 are cross-sectional views to show a sequence of steps for producing the electron device of FIG. 25.
Figure 27:
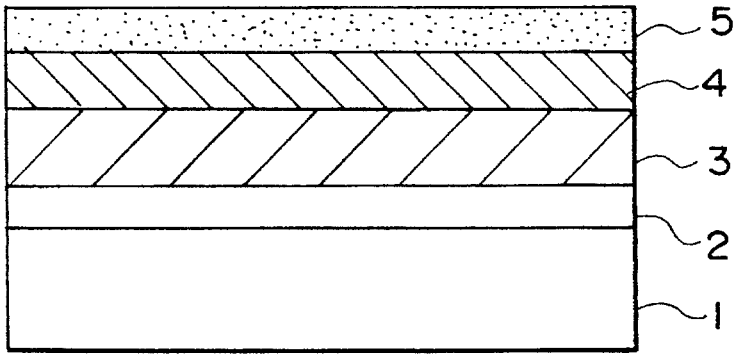
Figure 28:
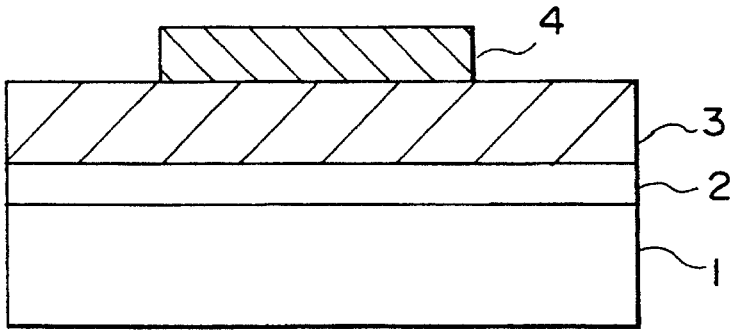
Figure 29:
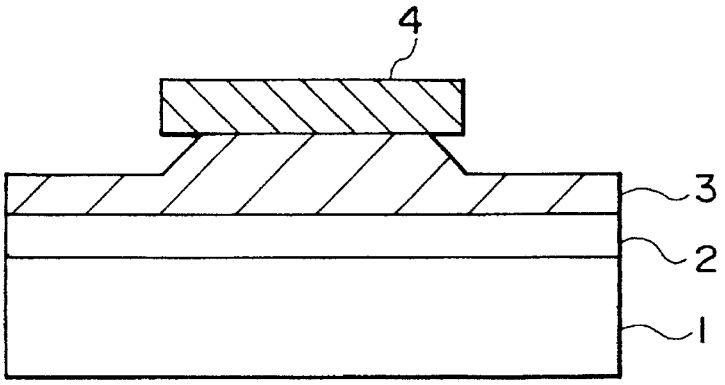
Figure 30:
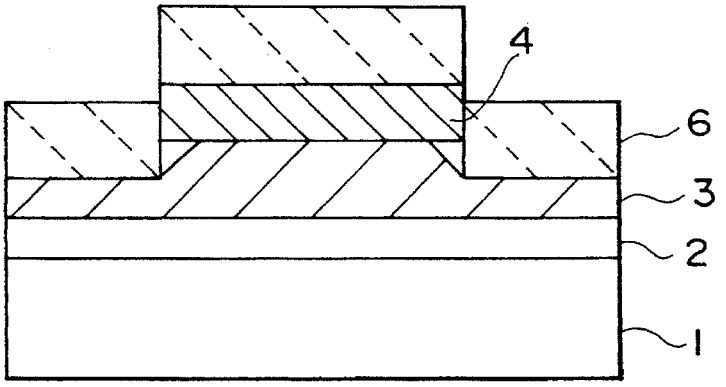
Figure 31:
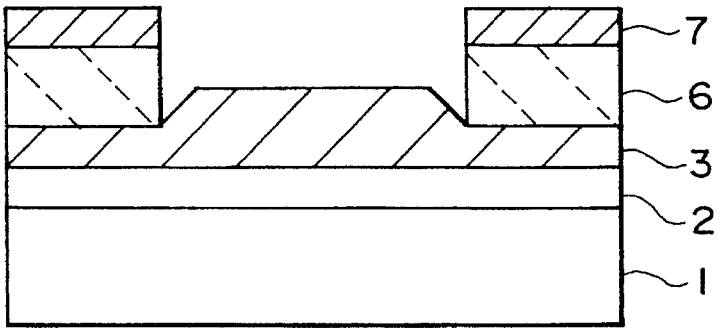

FIG. 25 shows the structure of a first modification of the above second embodiment. The present modification is constructed substantially in the same structure as the second embodiment except that the emitter portion has the bottom area in the range 1 to 10 μm square and the top area in the range 0.5 to 5 μm square, which is about a quarter of the bottom area, and that the height between the bottom and the top is 1/10 or more of the minimum width in the bottom. The operation of the thus constructed modification is substantially the same as that of the second embodiment.

FIG. 26 to FIG. 31 show a sequence of steps for producing the first modification. The first modification is produced substantially in the same manner as the second embodiment except that the pattern of the mask layer 4 covering the n-type layer 3 and the time for etching the n-type layer 3 need to be adjusted to define the top area of the emitter portion in the range 0.5 to 5 μm square.

Figure 32:
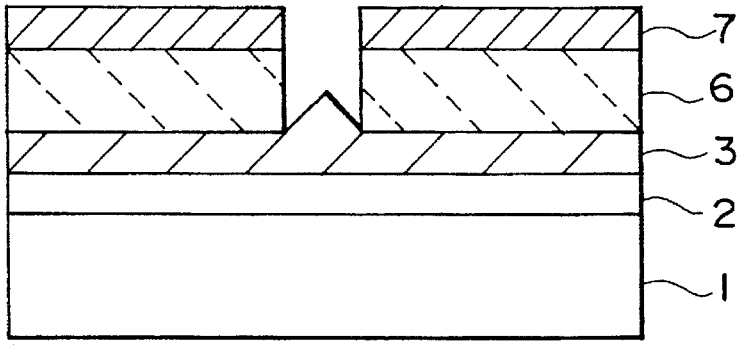
FIG. 32 is a cross-sectional view to show the structure of a second modification of the electron device of FIG. 18.
Figure 33:
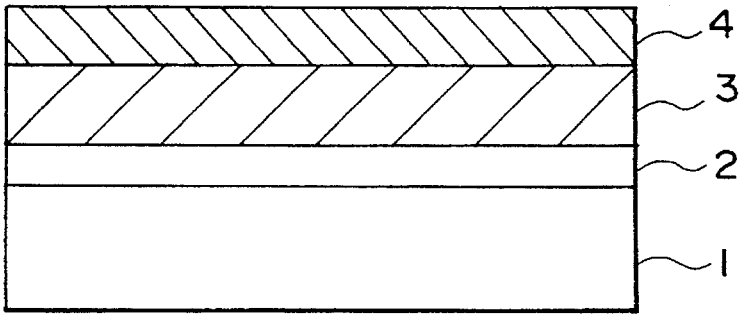
FIG. 33 to FIG. 38 are cross-sectional views to show a sequence of steps for producing the electron device of FIG. 32.
Figure 34:
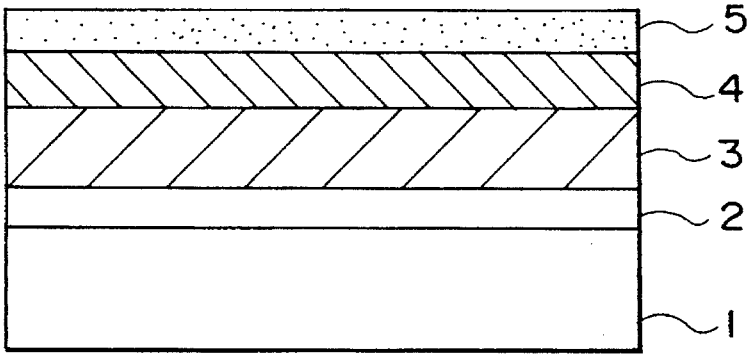
Figure 35:
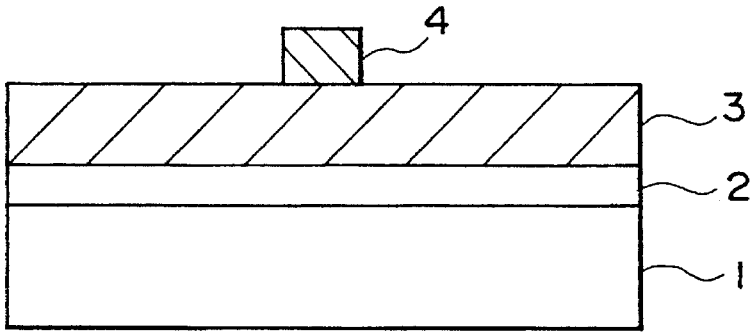
Figure 36:
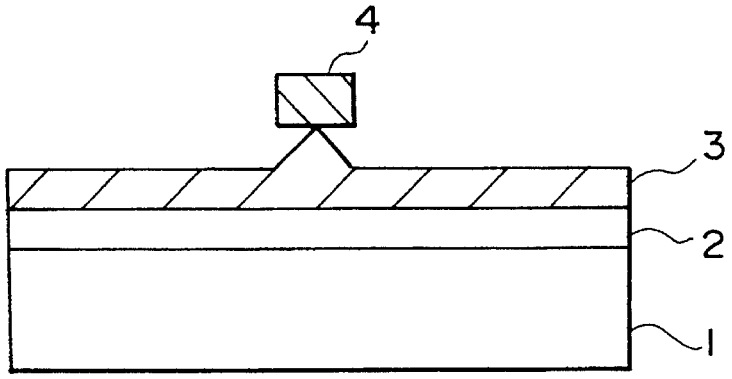
Figure 37:
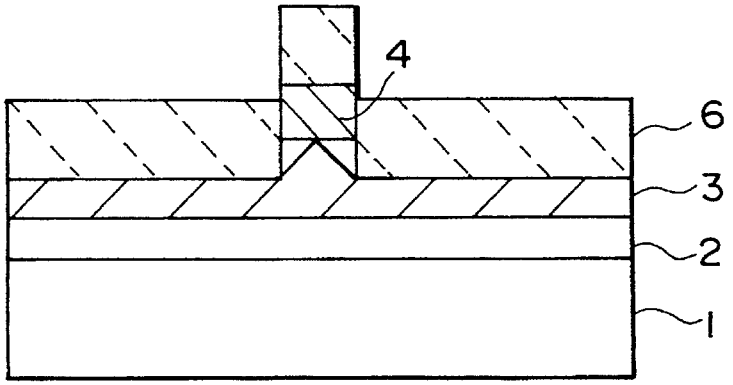
Figure 38:
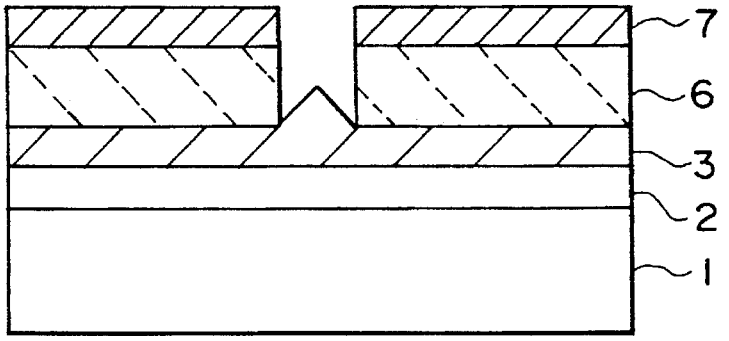

FIG. 32 shows the structure of a second modification of the second embodiment. The present modification is constructed substantially in the same structure as the above second embodiment except that the emitter portion has the bottom area in the range 1 to 10 μm square and the top area in the range 0.1 or less μm square, which is 1/100 or less of the bottom area, and that the height between the bottom and the top is 1/10 or more of the minimum width in the bottom. The operation of the thus constructed modification is substantially the same as that of the second embodiment.

FIG. 33 to FIG. 38 show a sequence of steps for producing the second modification. The present modification is produced substantially in the same manner as the second embodiment except that the pattern of the mask layer 4 covering the n-type layer 3 and the time for etching the n-type layer 3 need to be adjusted to define the top area of the emitter portion as being 0.1 or less μm square.

Figure 39:
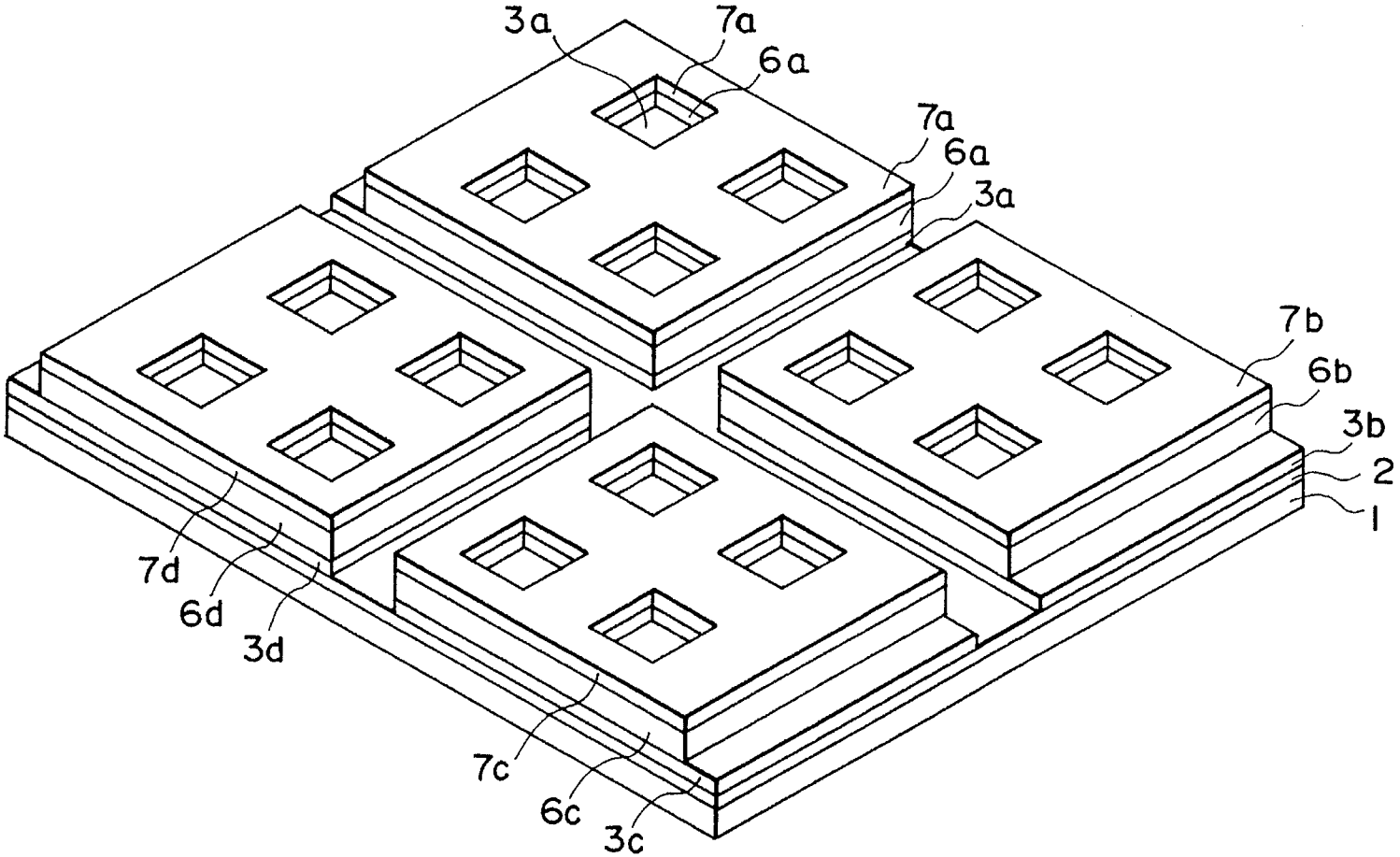
FIG. 39 is a plan view to show the structure of a third modification of the electron device of FIG. 18.

FIG. 39 shows the structure of a third modification of the second embodiment. In the present modification, a plurality of the above second embodiments are arranged on the i-type layer 2. In more detail, there are four n-type layers 3*a* to 3*d* arranged as separate from each other on the i-type layer 2. Each of the n-type layers 3*a* to 3*d* has a flat surface, and four protruded emitter portions are formed in a two-dimensional array in four predetermined regions so as to project from the flat surface. Each emitter portion is constructed substantially in the same structure as that of the second embodiment.

In the peripheral region beside each emitter portion, an insulating layer 6*a* to 6*d* and an anode electrode layer 7*a* to 7*d* are successively layered on the n-type layer 3*a* to 3*d*, respectively. Thus, the n-type layers 3*a* to 3*d* and the anode electrode layers 7*a* to 7*d* are electrically insulated by the i-type layer 2. Thus, the top of each emitter portion is exposed to the outside.

The operation of the third modification is next described.

Increasing the temperature of the substrate up to about 300° to about 600° C., generating an electric field near the surface of the emitter portions, and supplying an electric current to either one selected from the n-type layers 3*a* to 3*d*, electrons are emitted with a high efficiency into the vacuum from the tip portion of each emitter portion formed of the selected n-type layer. When the dopant concentration of nitrogen is high enough in the n-type layers 3*a* to 3*d*, electrons can be taken out with a high efficiency from the tip portion of each emitter portion by the field emission even at the temperature of the substrate near the room temperature.

Figure 40:
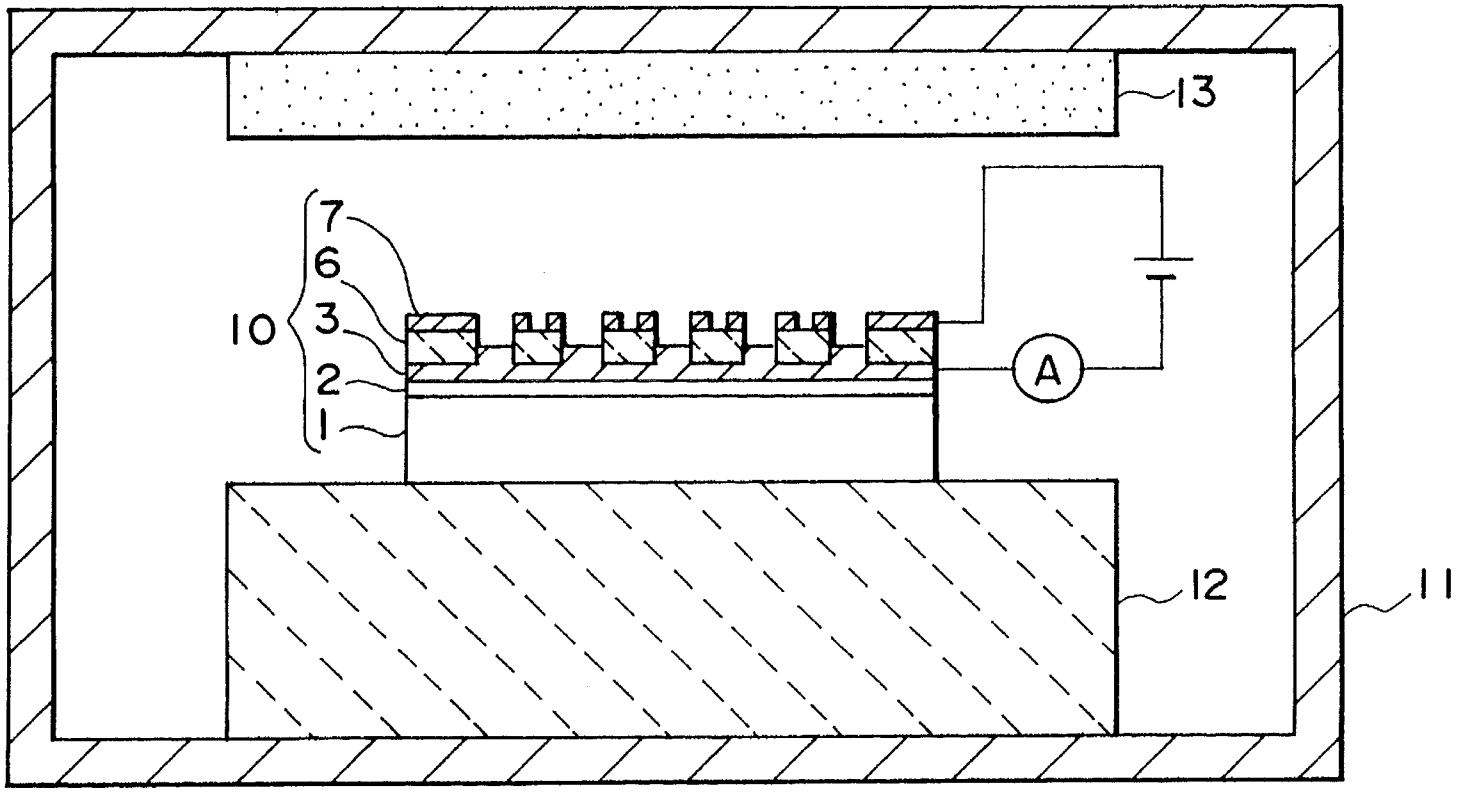
FIG. 40 is a partial cross-sectional view to show the structure of an experimental apparatus of the electron device of FIG. 18.

FIG. 40 shows the structure of an experimental apparatus according to the second embodiment. An electron device 10 is set inside a vacuum chamber 11, similarly as in the experiments in the first embodiment. However, the anode electrode plate 14 is excluded, and the power supply and current meter are connected in series between the anode electrode layer 7 and the n-type layer 3.

Here, a plurality of emitter portions formed of the n-type layer 3 on the 1 mm-square substrate 1 are arranged at intervals of 5 to 50 μm in a two-dimensional array on the surface of the electron device 10. Each emitter portion is formed in the same manner as in the second embodiment except that the dopant concentrations of nitrogen and boron in the n-type layer 3 are changed in a certain range. The anode electrode layers 7 corresponding to the emitter portions are formed as separate from each other. Further, the wiring connecting the power supply and the current meter between the anode electrode layer 7 and the n-type layer 3 may be so arranged that they can be electrically connected with a selected emitter portion by switching.

The heating holder was first activated to set the temperature of the substrate 1 in the range of 20° to 600° C. The power supply was then activated to apply a voltage of 10 V between a selected emitter portion and the anode electrode layer 7 in the electron device 10, generating an electric field. A flow of electrons emitted from the electron device 10 because of the generated electric field was measured by the current meter.

FIG. 90 shows changes of the emission current against the dopant concentrations of nitrogen and boron where the n-type layer 3 is made of bulk single crystal diamond synthesized under a high pressure.

FIG. 91 shows changes of the emission current against the dopant concentrations of nitrogen and boron where the n-type layer 3 is made of single crystal diamond (an epitaxial layer) vapor-phase-synthesized on the substrate 1 made of single crystal diamond.

FIG. 92 shows changes of the emission current against the dopant concentrations of nitrogen and boron where the n-type layer 3 is made of polycrystal diamond vapor-phase-synthesized on the substrate 1 made of silicon.

It is seen from the above results that a sufficient emission current can be attained if the dopant concentration $C_N$ of nitrogen in the n-type layer 3 is not less than $1\times10^{19}$ $cm^{-3}$. It is also understood that a sufficient emission current can be attained if the dopant concentrations $C_N$, $C_B$ of nitrogen and boron in the n-type layer 3 satisfy the relation of $100C_B \geqq C_N > C_b$, more preferably the relation of $10C_B \geqq C_N > C_B$.

Third Embodiment

Figure 41:
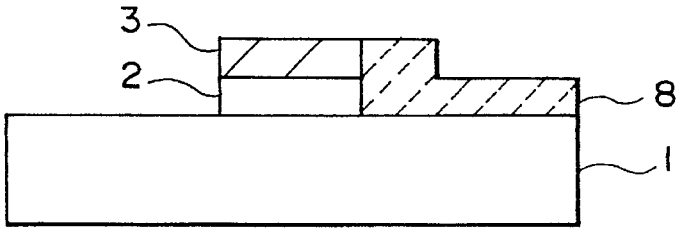
FIG. 41 is a cross-sectional view to show the structure of the third embodiment of the electron device according to the present invention.

FIG. 41 shows the structure of the third embodiment of the electron device according to the present invention. An i-type layer 2 and an n-type layer 3 are successively layered on a substrate 1. The substrate 1 has a flat surface. The i-type layer 2 and n-type layer 3 are formed as a protruded emitter portion to project from the flat surface in a predetermined region of the flat surface. The emitter portion has the bottom area in the range 1 to 10 μm square and the top area in the range 1 to 10 μm square, which is approximately the same as the bottom area, and the height between the bottom and the top is 1/10 or more of the minimum width in the bottom.

In the peripheral region beside the emitter portion, a wiring layer 8 is formed in contact with the n-type layer 3 and on the substrate 1.

Here, the substrate 1, the i-type layer 2, and the n-type layer 3 are formed substantially in the same manner as in the above first embodiment. However, the substrate 1 is an insulator substrate made of an artificial single crystal diamond synthesized under a high pressure. The n-type layer 3 is made of a low-resistance diamond having the layer thickness of about 1 μm. The wiring layer 8 is formed by vapor deposition of a metal having good conductivity.

The operation of the thus constructed embodiment is substantially the same as the first embodiment.

FIG. 42 to FIG. 46 show a sequence of steps for producing the third embodiment.

Figure 42:
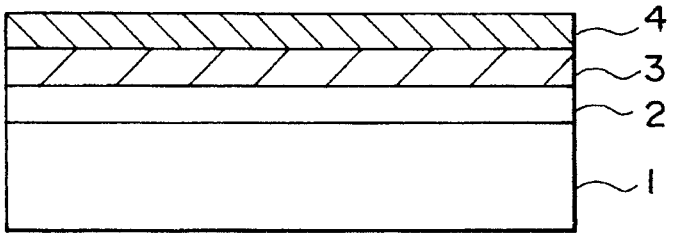
FIG. 42 to FIG. 46 are cross-sectional views to show a sequence of steps for producing the electron device of FIG. 41.

First, the i-type layer 2, the n-type layer 3, and the mask layer 4 are successively layered on the substrate 1 by the microwave plasma CVD method. Here, the i-type layer 2, the n-type layer 3, and the mask layer 4 are formed under the substantially same production conditions as in the first embodiment (FIG. 42).

Figure 43:
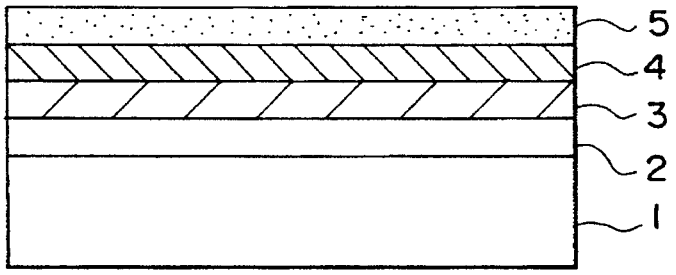

Next, a photoresist layer 5 is formed on the mask layer 4 by the ordinary spin coating method (FIG. 43).

Figure 44:
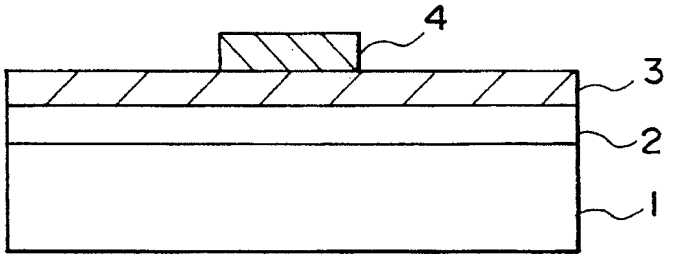

Then a predetermined pattern is formed in the resist layer 5, based on the ordinary photolithography technology. Subsequently, the mask layer 4 is patterned in accordance with the pattern of the resist layer 5, based on the ordinary etching technology, and thereafter the resist layer 5 is removed (FIG. 44).

Figure 45:
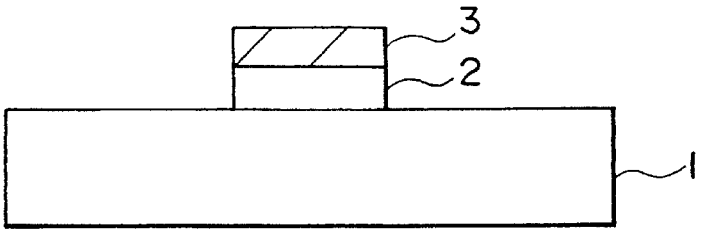

Next, the n-type layer 3 and i-type layer 2 are patterned in accordance with the pattern of the mask layer 4 by the dry etching method using Ar gas containing 1% by volume of $O_2$, and thereafter the mask layer 4 is removed. Here, the peripheral region of the n-type layer 3 and i-type layer 2 exposed out from the pattern of the mask layer 4 is etched to form a flat surface, so that the emitter portion projecting from the surface of the peripheral portion is formed in the inner region of the n-type layer 3 covered with the pattern of the mask layer 4 (FIG. 45 ).

Figure 46:
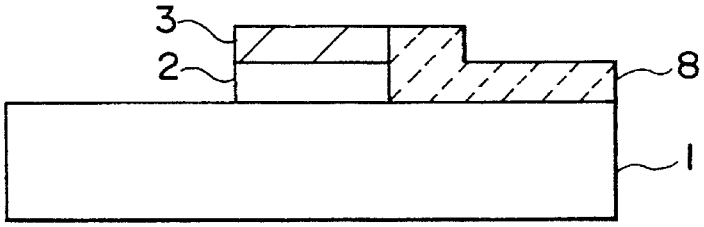

Then the wiring layer 8 is formed by vapor-depositing the metal having good conductivity on the substrate 1 located in the peripheral region beside the emitter portion so as to be in contact with the n-type layer 3 ( FIG. 46 ).

Figure 47:
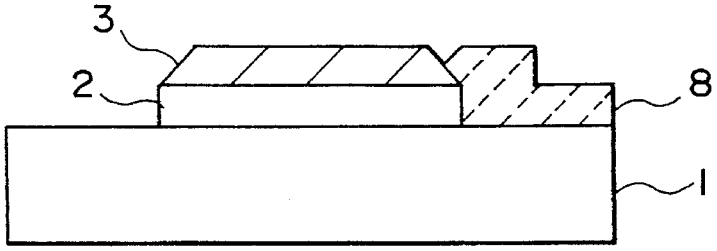
FIG. 47 is a cross-sectional view to show the structure of a first modification of the electron device of FIG. 41.
Figure 48:
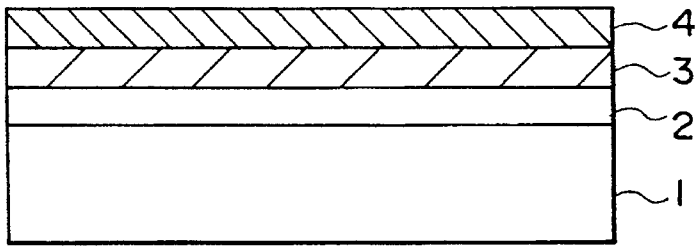
FIG. 48 to FIG. 52 are cross-sectional views to show a sequence of steps for producing the electron device of FIG. 47.
Figure 49:
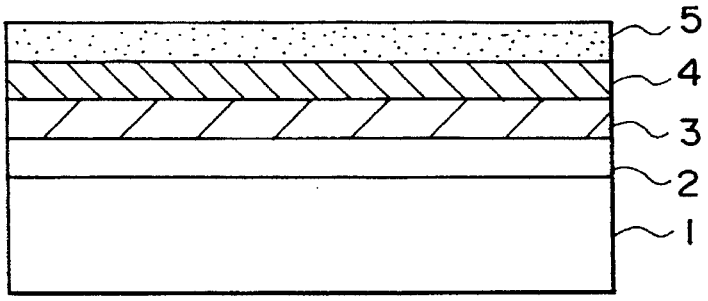
Figure 50:
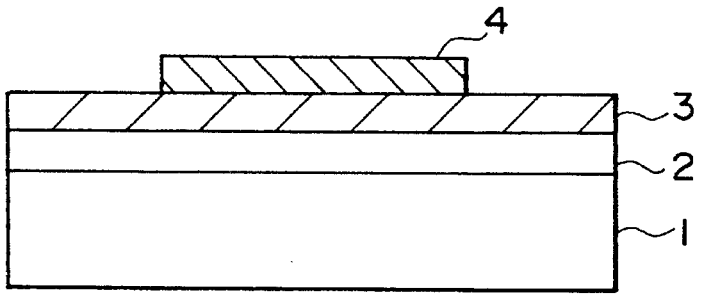
Figure 51:
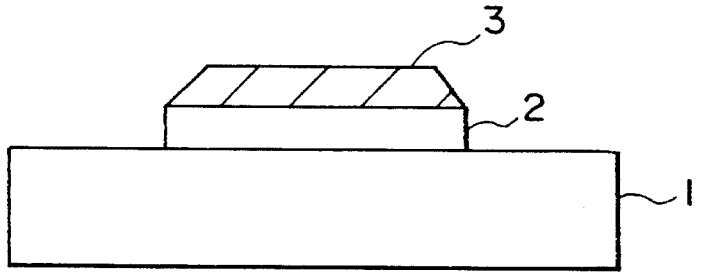
Figure 52:
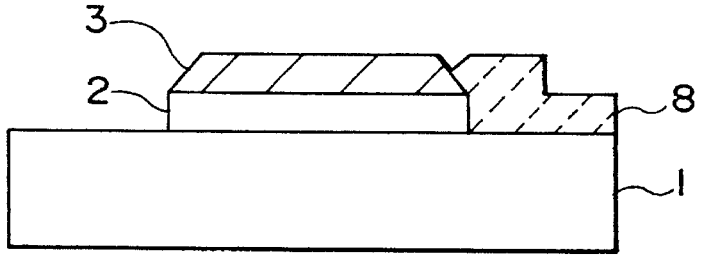

FIG. 47 shows the structure of a first modification of the third embodiment. The present modification is constructed substantially in the same structure as the above third embodiment except that the emitter portion has the bottom area in the range 1 to 10 μm square and the top area in the range 0.5 to 5 μm square, which is about a quarter of the bottom area, and that the height between the bottom and the top is 1/10 or more of the minimum width in the bottom. The operation of the thus constructed modification is substantially the same as that of the third embodiment.

FIG. 42 to FIG. 52 show a sequence of steps for producing the above first modification. The present modification is produced substantially in the same manner as the third embodiment except that the pattern of the mask layer 4 covering the n-type layer 3 and the time for etching the n-type layer 3 need to be adjusted to define the top area of the emitter portion in the range 0.5 to 5 μm square.

Figure 53:
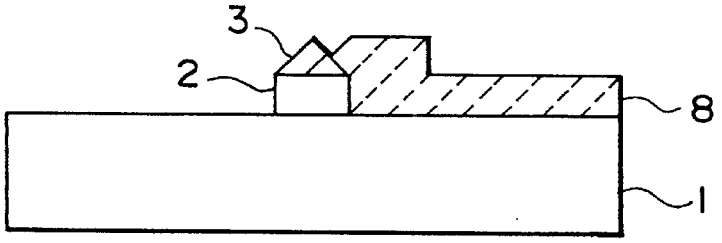
FIG. 53 is a cross-sectional view to show the structure of a second modification of the electron device of FIG. 41.
Figure 54:
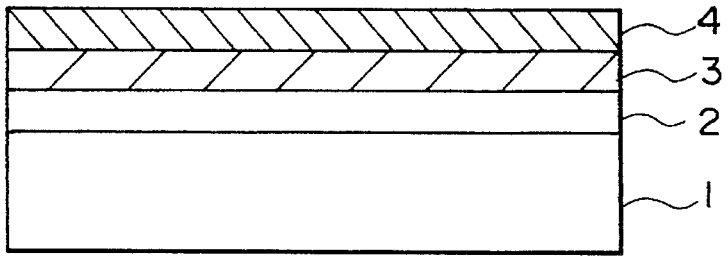
FIG. 54 to FIG. 58 are cross-sectional views to show a sequence of steps for producing the electron device of FIG. 53.
Figure 55:
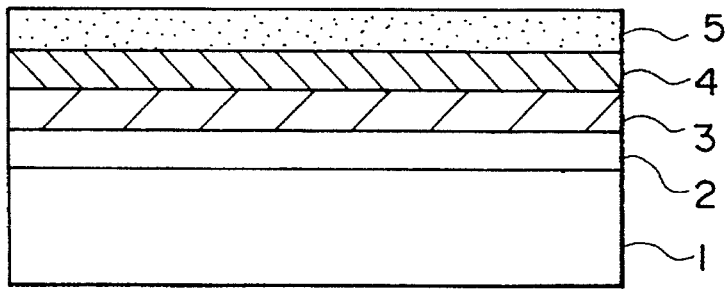
Figure 56:
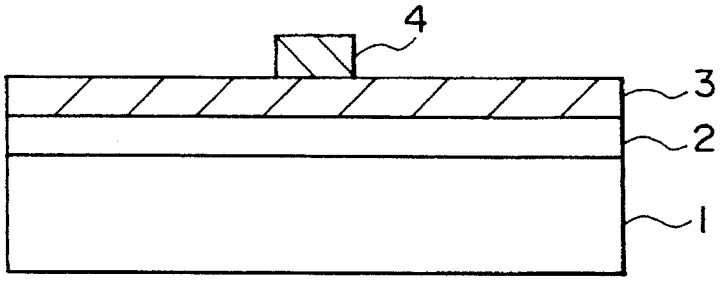
Figure 57:
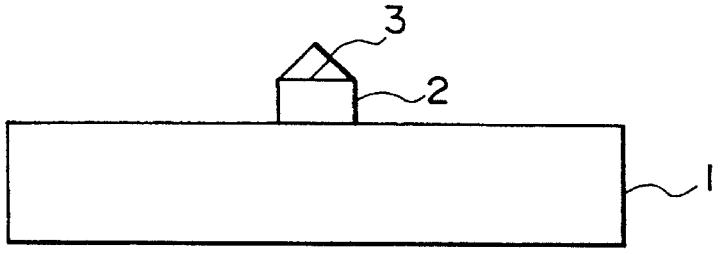
Figure 58:
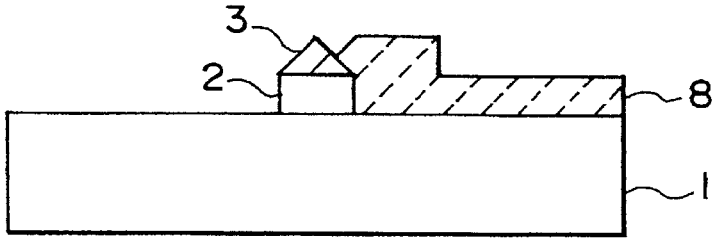

FIG. 53 shows the structure of a second modification of the third embodiment. The present modification is constructed substantially in the same structure as the third embodiment except that the emitter portion has the bottom area in the range 1 to 10 μm square and the top area in the range 0.1 or less μm square, which is 1/100 or less of the bottom area, and that the height between the bottom and the top is 1/10 or more of the minimum width in the bottom. The operation of the thus constructed modification is substantially the same as that of the third embodiment.

FIG. 54 to FIG. 58 show a sequence of steps for producing the above second modification. The present modification is produced substantially in the same manner as the third embodiment except that the pattern of the mask layer 4 covering the n-type layer 3 and the time for etching the n-type layer 3 need to be adjusted to define the top area of the emitter portion as being 0.1 or less μm square.

Figure 59:
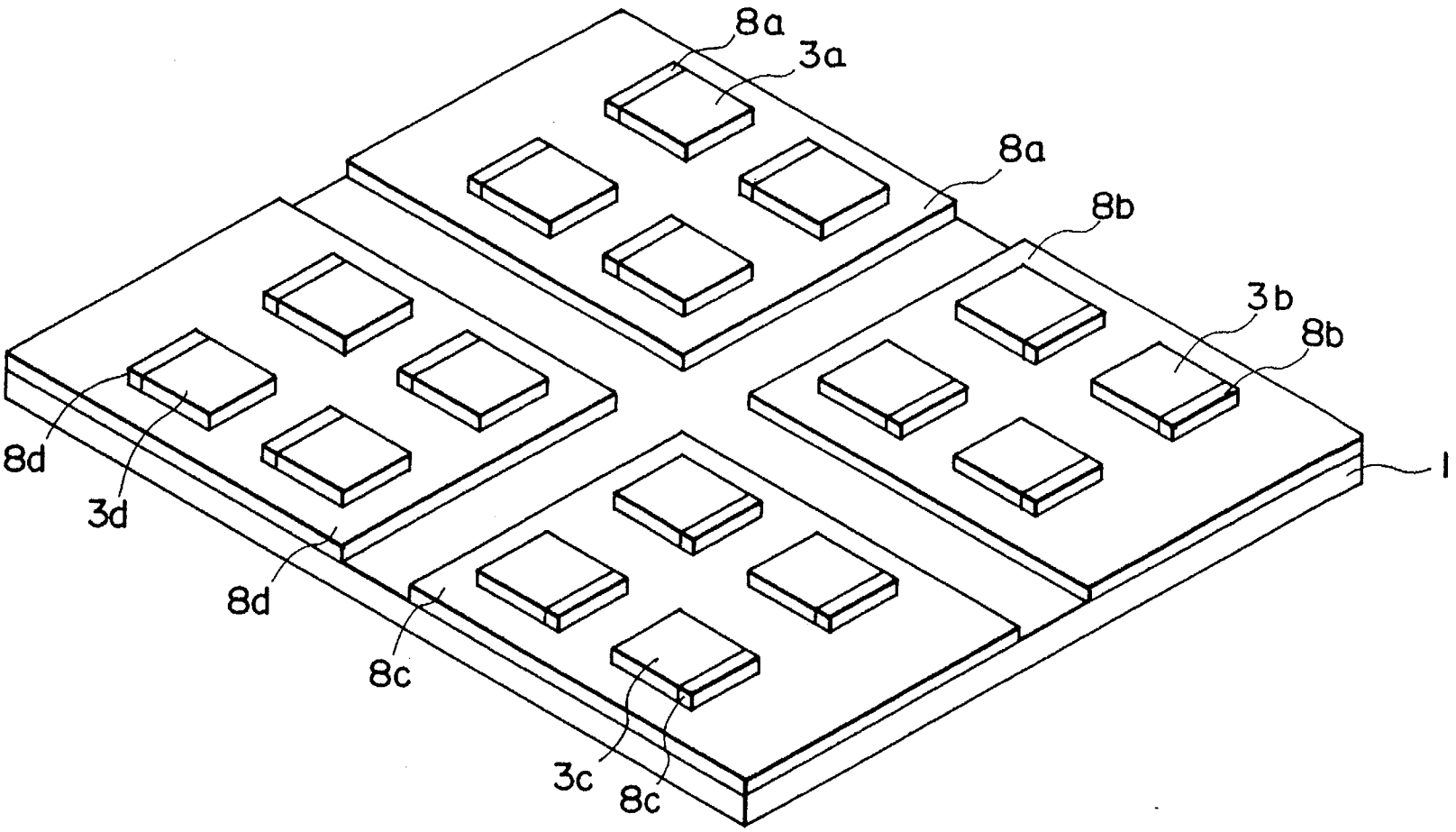
FIG. 59 is a plan view to show the structure of a third modification of the electron device of FIG. 41.

FIG. 59 shows the structure of a third modification of the third embodiment. In the present modification, a plurality of the above third embodiments are arranged on the substrate 1. In more detail, four i-type layers 2*a* to 2*d* and four n-type layers 3*a* to 3*d* are successively layered on the substrate 1. The substrate 1 has a flat surface, and four protruded emitter portions are formed in a two-dimensional array in four predetermined regions so as to project from the flat surface. Each emitter portion is constructed substantially in the same structure as that of the third embodiment.

In the peripheral regions beside the emitter portions, wiring layers 8*a* to 8*d* are formed in contact with the n-type layers 3*a* to 3*d*, respectively, so as to be separate from each other. Thus, the n-type layers 3*a* to 3*d* are electrically insulated from each other by the substrate 1.

The operation of the third modification is next described.

Increasing the temperature of the substrate up to about 300° to about 600° C., generating an electric field near the surface of the emitter portions, and supplying an electric current to either one selected from the wiring layers 8*a* to 8*d*, electrons are emitted with a high efficiency into the vacuum from the tip portion of each emitter portion connected with the selected wiring layer. When the dopant concentration of nitrogen in the n-type layers 3*a* to 3*d* is high enough, electrons can be taken out with a high efficiency from the tip portion of each emitter portion by the field emission even at the temperature of the substrate near the room temperature.

Figure 60:
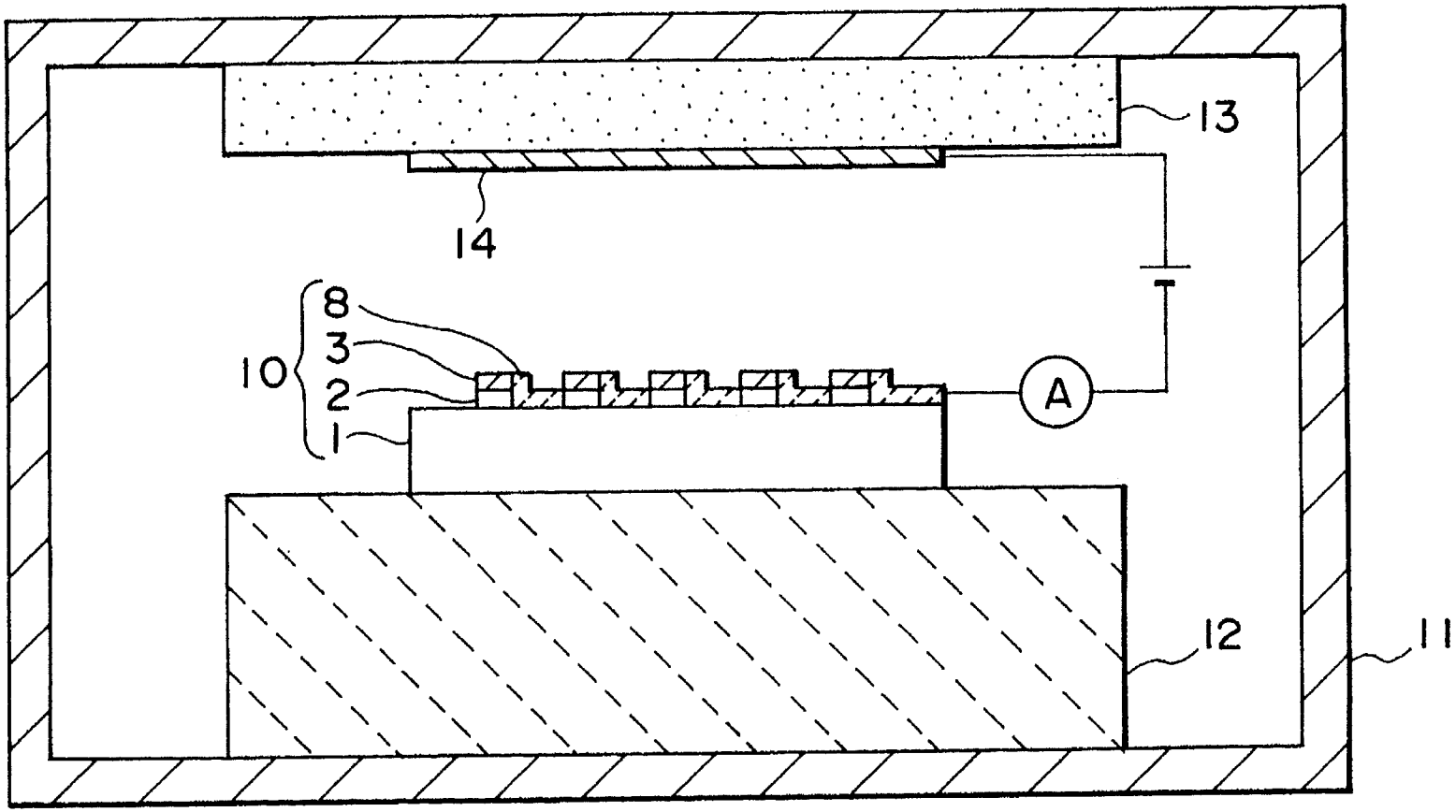
FIG. 60 is a partial cross-sectional view to show the structure of an experimental apparatus of the electron device of FIG. 41.

FIG. 60 is an explanatory drawing to illustrate experiments for the third embodiment. An electron device 10 is set inside a vacuum chamber 11, similarly as in the experiments for the first embodiment.

Here, a plurality of emitter portions formed of the i-type layer 2 and n-type layer 3 on the 1 mm-square substrate 1 are arranged at intervals of 5 to 50 μm in a two-dimensional array on the surface of the electron device 10. Each emitter portion is formed substantially in the same manner as the third embodiment except that the dopant concentrations of nitrogen and boron in the n-type layer 3 are changed in a certain range.

The heating holder was first activated to set the temperature of the substrate 1 in the range of 20° to 600° C. The power supply was then activated to apply a voltage of 10 v between the electron device 10 and the anode electrode plate 14, generating an electric field. A flow of electrons emitted from the electron device 10 because of the generated electric field was measured by the current meter.

FIG. 93 shows changes of the emission current against the dopant concentrations of nitrogen and boron where the n-type layer 3 is made of single crystal diamond (an epitaxial layer) vapor-phase-synthesized on the substrate 1 made of single crystal diamond.

FIG. 94 shows changes of the emission current against the dopant concentrations of nitrogen and boron where the n-type layer 3 is made of polycrystal diamond vapor-phase-synthesized on the substrate 1 made of silicon.

It is seen from the above results that a sufficient emission current can be obtained if the dopant concentration $C_N$ of nitrogen in the n-type layer 3 is not less than $1\times10^{19}$ $cm^{-3}$. It is also understood that a sufficient emission current can be attained if the dopant concentrations $C_N$, $C_B$ of nitrogen and boron in the n-type layer 3 satisfy the relation of $100C_B \geqq C_N > C_B$, more preferably the relation of $10C_B \geqq C_N > C_B$.

Fourth Embodiment

Figure 61:
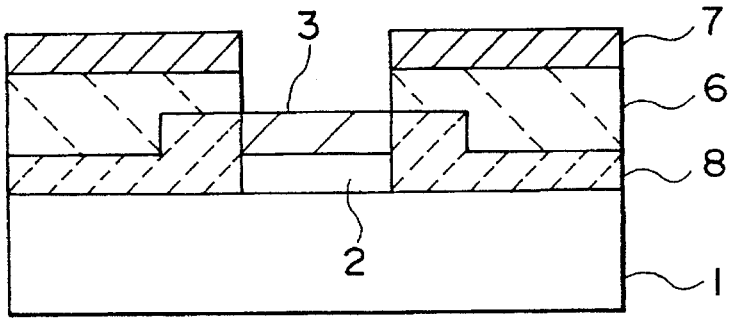
FIG. 61 is a cross-sectional view to show the structure of the fourth embodiment of the electron device according to the present invention.

FIG. 61 shows the structure of the fourth embodiment of the electron device according to the present invention. An i-type layer 2, an n-type layer 3, a wiring layer 8, an insulating layer 6, and an anode electrode layer 7 are successively layered on a substrate 1. The substrate 1 has a flat surface. In a predetermined region of the substrate 1, the i-type layer 2 and n-type layer 3 are formed as a protruded emitter portion to project from the flat surface. The emitter portion has the bottom area in the range 1 to 10 μm square and the top area in the range 1 to 10 μm square, which is substantially the same as the bottom area, and the height between the bottom and the top is 1/10 or more of the minimum width in the bottom.

In the peripheral region beside the emitter portion, the wiring layer 8 is formed on the substrate 1 in contact with the n-type layer 3. Further, the insulating layer 6 and anode electrode layer 7 are successively layered on the wiring layer 8. Thus, the top of the emitter portion is exposed to the outside.

Here, the i-type layer 2 and n-type layer 3 are formed substantially in the same manner as in the first embodiment, but the substrate 1 is an insulator substrate made of an artificial single crystal diamond synthesized under a high pressure. The n-type layer 3 is made of a low-resistance diamond having the layer thickness of about 1 μm. The wiring layer 8 is formed by vapor deposition of a metal having good conductivity.

The insulating layer 6 is formed by vapor deposition of $SiO_2$. The anode electrode layer 7 is formed by vapor deposition of a metal having good conductivity.

The operation of the thus constructed embodiment is substantially the same as that of the first embodiment except that electrons emitted from the emitter portion are captured by the anode electrode layer 7 to be detected, because the anode electrode layer 7 is formed in the peripheral portion of the n-type layer 3 excluding the emitter portion.

FIG. 62 to FIG. 68 show a sequence of steps for producing the above fourth embodiment.

Figure 62:
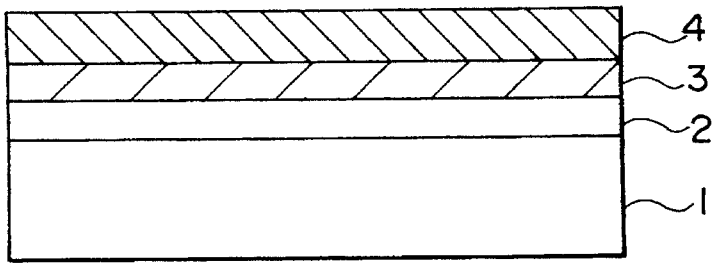
FIG. 62 to FIG. 68 are cross-sectional views to show a sequence of steps for producing the electron device of FIG. 61.

First, the i-type layer 2, the n-type layer 3, and the mask layer 4 are successively layered on the substrate 1 by the microwave plasma CVD method. Here, the i-type layer 2, the n-type layer 3, and the mask layer 4 are formed substantially under the same production conditions as in the first embodiment (FIG. 62).

Figure 63:
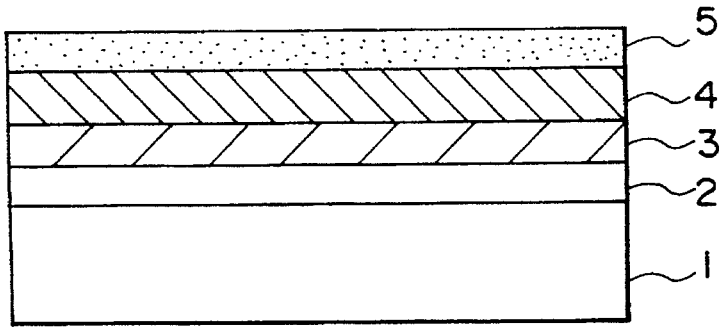

Next, a photoresist layer 5 is formed on the mask layer 4 by the ordinary spin coating method (FIG. 63).

Figure 64:
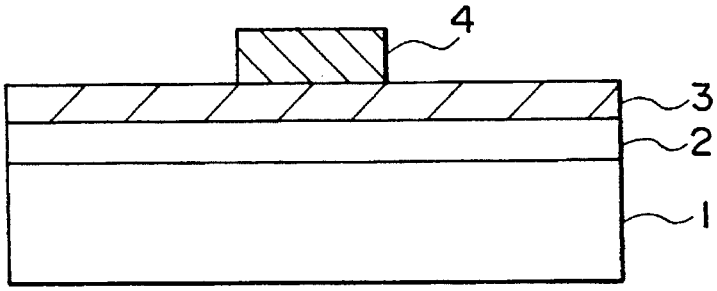

Then a predetermined pattern is formed in the resist layer 5, based on the ordinary photolithography technology. Subsequently, the mask layer 4 is patterned in accordance with the pattern of the resist layer 5, based on the ordinary etching technology, and thereafter the resist layer 5 is removed (FIG. 64).

Figure 65:
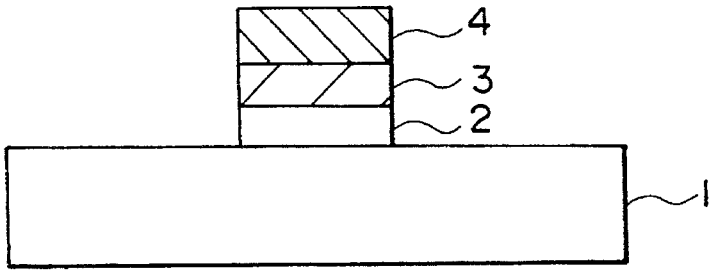

Next, the n-type layer 3 and i-type layer 2 are patterned in accordance with the pattern of the mask layer 4 by the dry etching method using Ar gas containing 1% by volume of $O_2$. Here, the peripheral region of the n-type layer 3 and i-type layer 2 exposed out from the pattern of the mask layer 4 is etched to form a flat surface, so that the emitter portion projecting from the surface of the peripheral region is formed in the inner region of the n-type layer 3 covered with the pattern of the mask layer 4 (FIG. 65).

Figure 66:
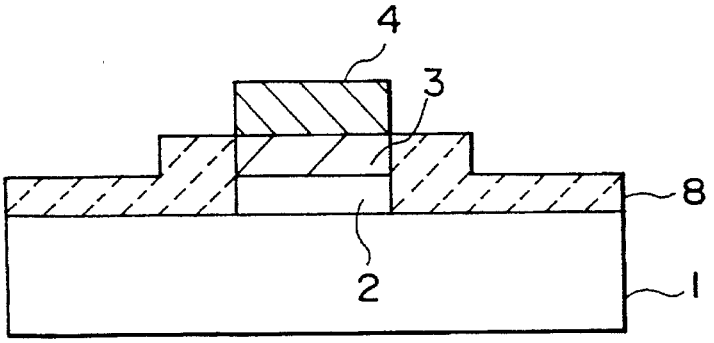

Next, the wiring layer 8 is formed by vapor-depositing the metal having good conductivity on the substrate 1 located in the peripheral region beside the emitter portion so as to be in contact with the n-type layer 3 (FIG. 66).

Figure 67:
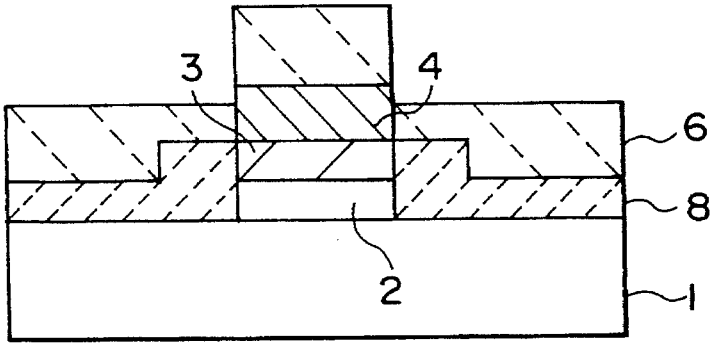

Then the insulating layer 6 is formed by vapor-depositing $SiO_2$ on the substrate 1 and the mask layer 4 (FIG. 67).

Figure 68:
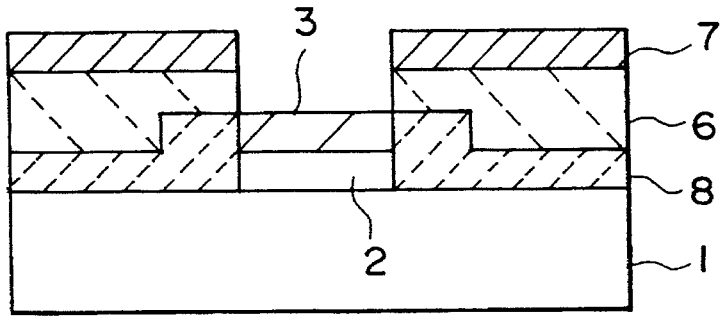

Then the anode electrode layer 7 is formed by vapor-depositing the metal having good conductivity on the insulating layer 6 located in the peripheral region beside the emitter portion, and thereafter the insulating layer 6 and mask layer 4 over the emitter portion are removed (FIG. 68).

Figure 69:
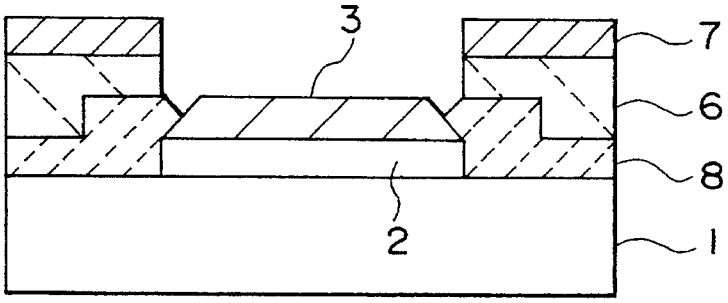
FIG. 69 is a cross-sectional view to show the structure of a first modification of the electron device of FIG. 61.
Figure 70:
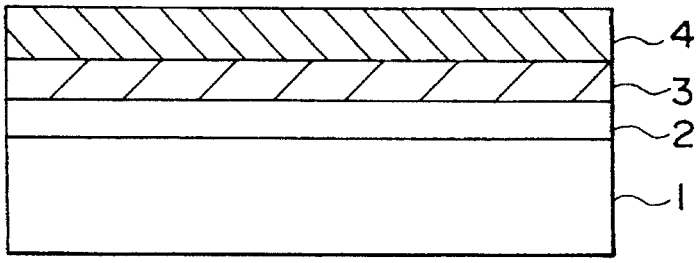
FIG. 70 to FIG. 76 are cross-sectional views to show a sequence of steps for producing the electron device of FIG. 69.
Figure 71:
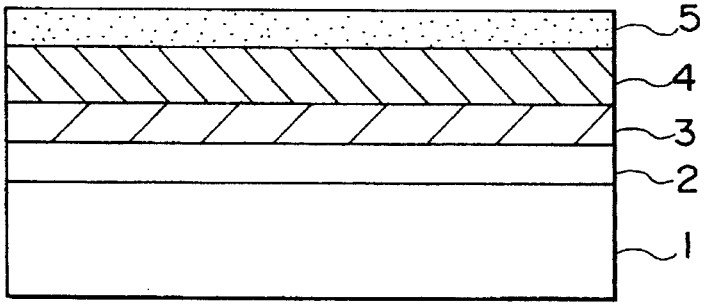
Figure 72:
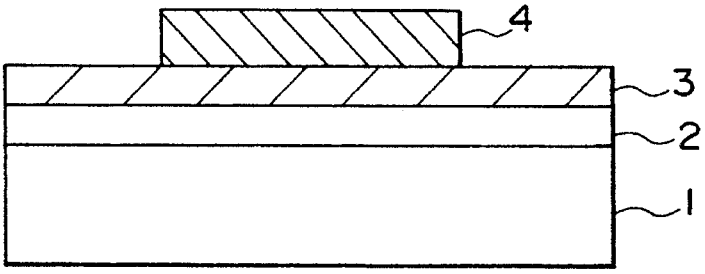
Figure 73:
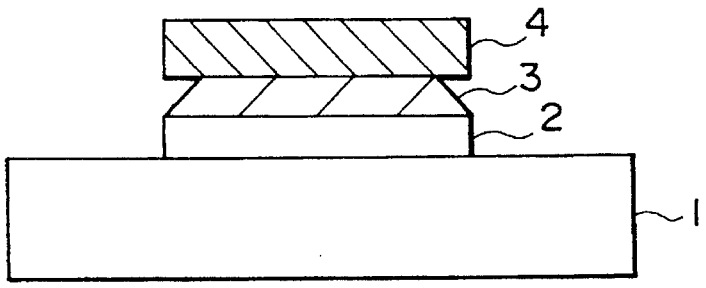
Figure 74:
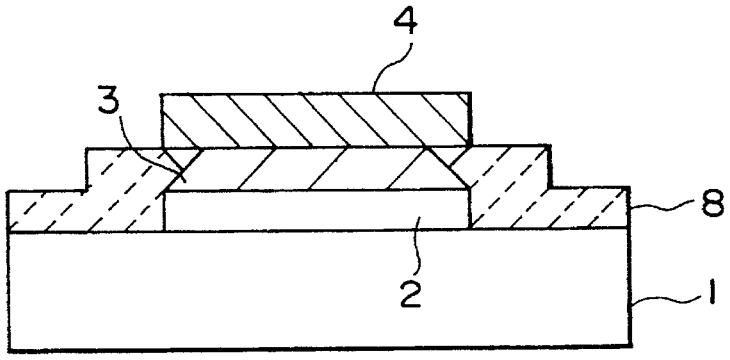
Figure 75:
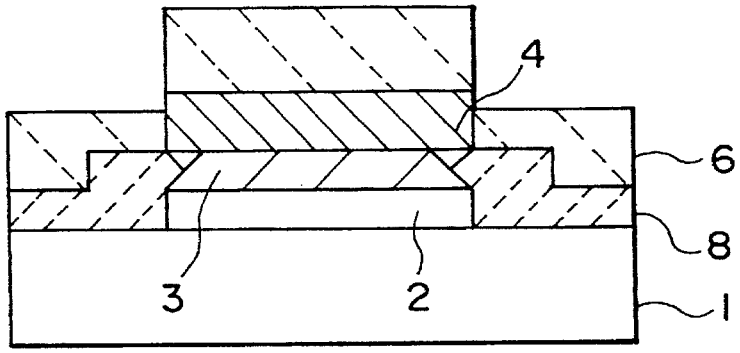
Figure 76:
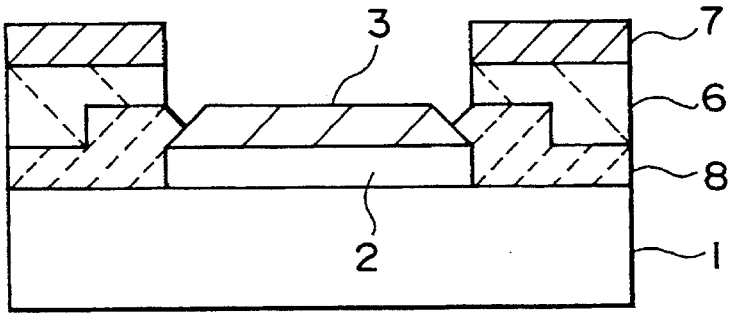

FIG. 69 shows the structure of a first modification of the fourth embodiment. The present modification is constructed substantially in the same structure as the fourth embodiment except that the emitter portion has the bottom area in the range 1 to 10 μm square and the top area in the range 0.5 to 5 μm square, which is about a quarter of the bottom area, and that the height between the bottom and the top is 1/10 or more of the minimum width in the bottom. The operation of the thus constructed modification is substantially the same as that of the fourth embodiment.

FIG. 70 to FIG. 76 show a sequence of steps for producing the first modification. The present modification is produced substantially in the same manner as the fourth embodiment except that the pattern of the mask layer 4 covering the n-type layer 3 and the time for etching the n-type layer 3 need to be adjusted to define the top area of the emitter portion in the range of 0.5 to 5 μm square.

Figure 77:
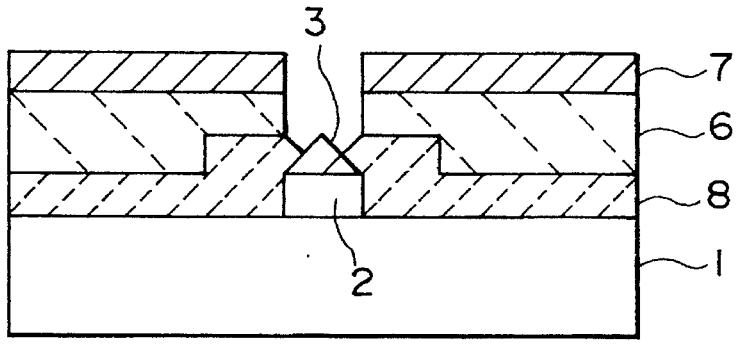
FIG. 77 is a cross-sectional view to show the structure of a second modification of the electron device of FIG. 61.
Figure 78:
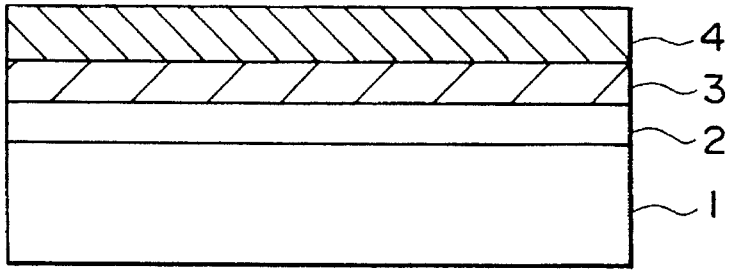
FIG. 78 to FIG. 84 are cross-sectional views to show a sequence of steps for producing the electron device of FIG. 77.
Figure 79:
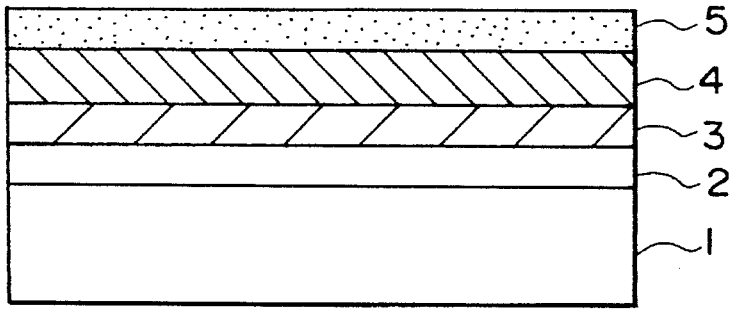
Figure 80:
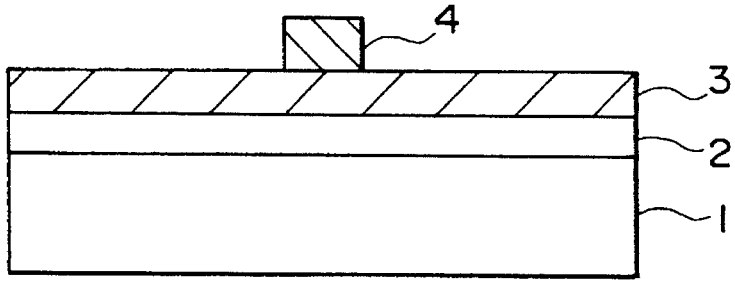
Figure 81:
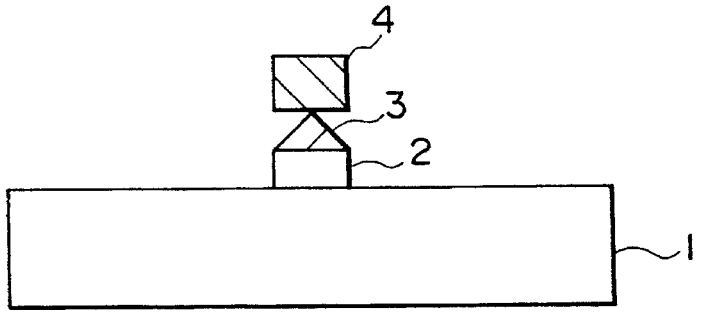
Figure 82:
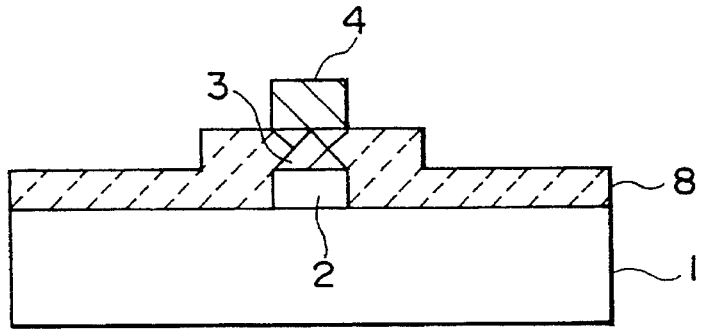
Figure 83:
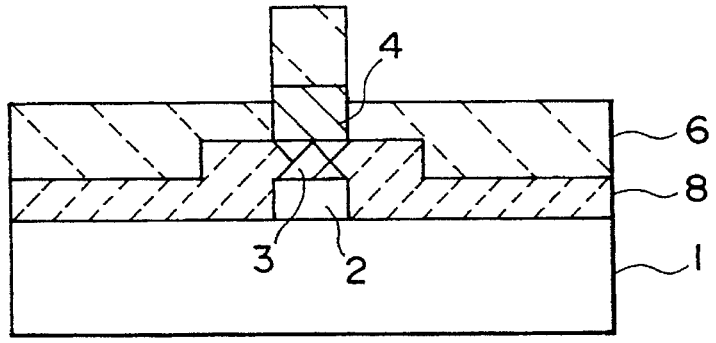
Figure 84:
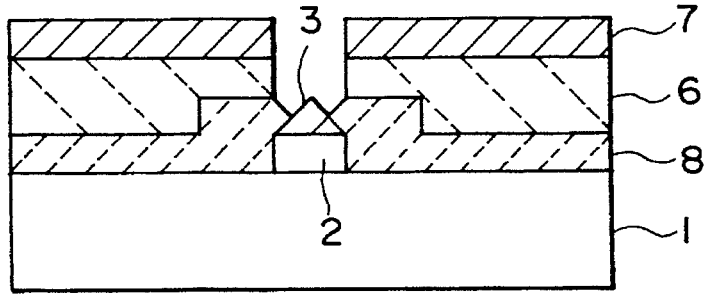

FIG. 77 shows the structure of a second modification of the fourth embodiment. The present modification is constructed substantially in the same structure as the fourth embodiment except that the emitter portion has the bottom area in the range 1 to 10 μm square and the top area in the range 0.1 or less μm square, which is 1/100 or less of the bottom area, and that the height between the bottom and the top is 1/10 or more of the minimum width in the bottom. The operation of the thus constructed modification is substantially the same as that of the fourth embodiment.

FIG. 78 to FIG. 84 show a sequence of steps for producing the above second modification. The present modification is produced substantially in the same manner as the fourth embodiment except that the pattern of the mask layer 4 covering the n-type layer 3 and the time for etching the n-type layer 3 need to be adjusted to define the top area of the emitter portion as being 0.1 or less μm square.

Figure 85:
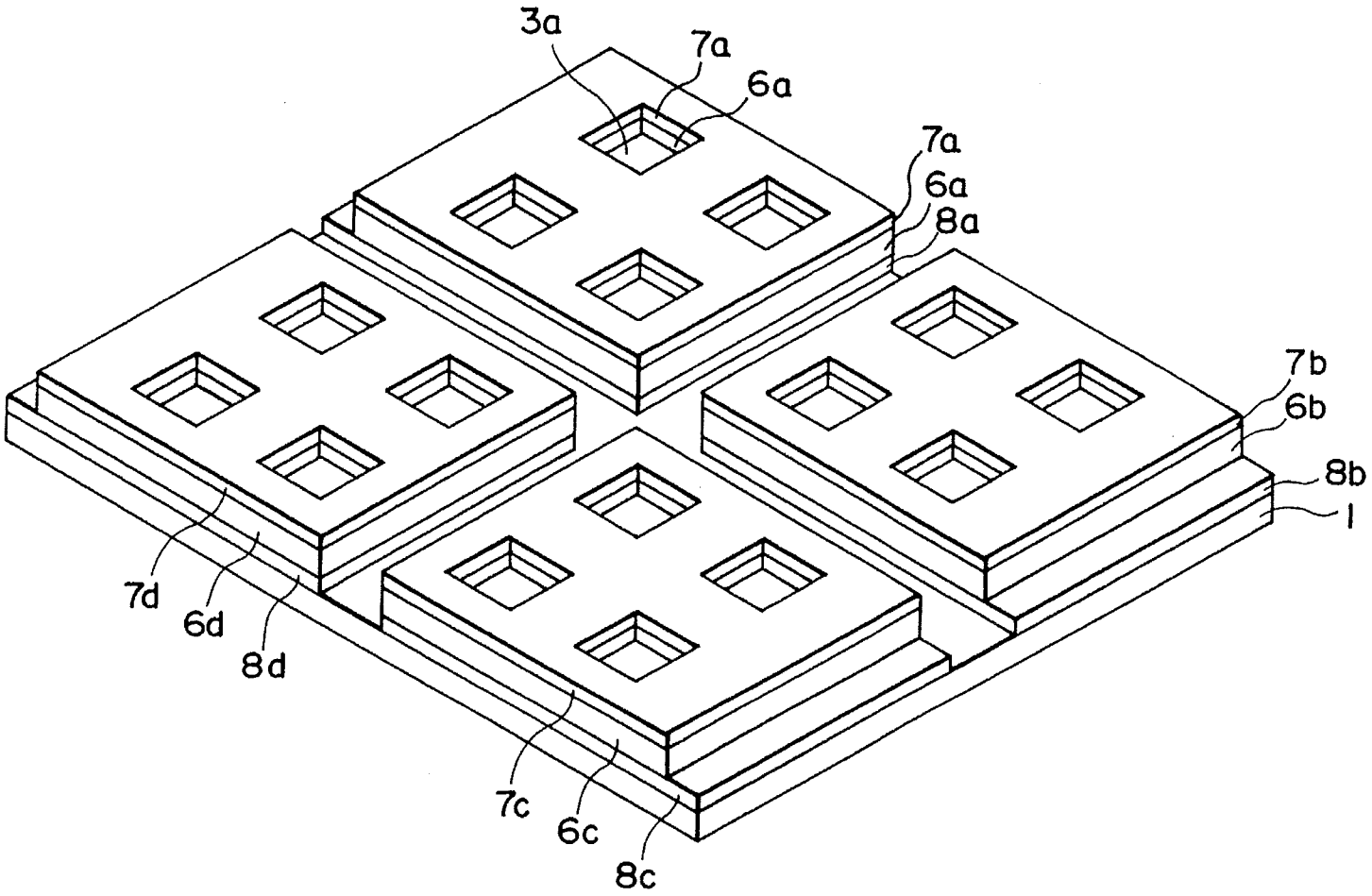
FIG. 85 is a plan view to show the structure of a third modification of the electron device of FIG. 61.

FIG. 85 shows the structure of a third modification of the fourth embodiment. In the present modification, a plurality of the above fourth embodiments are arranged on the substrate 1. In more detail, four i-type layers 2*a* to 2*d* and four n-type layers 3*a* to 3*d* are successively layered on the substrate 1. The substrate 1 has a flat surface, and four protruded emitter portions are formed in a two-dimensional array in four predetermined regions so as to project from the flat surface. Each emitter portion is constructed substantially in the same structure as that of the fourth embodiment.

In peripheral regions beside the emitter portions, wiring layers 8*a* to 8*d*, insulating layers 6*a* to 6*d*, and anode electrode layers 7*a* to 7*d* are successively layered on the substrate 1. These wiring layers 8*a* to 8*d* are formed in contact with the n-type layers 3*a* to 3*d*, respectively, and as being separate from each other. Thus, the n-type layers 3*a* to 3*d* and wiring layers 8*a* to 8*d* are electrically insulated by the substrate 1 and the i-type layers 2*a* to 2*d*, respectively. Thus, each emitter portion is exposed to the outside.

The operation of the above third modification is next described.

Increasing the temperature of the substrate up to about 300° to about 600° C., generating an electric field near the surface of the emitter portion, and supplying an electric current to either one selected from the wiring layers 8*a* to 8*d*, electrons are emitted with a high efficiency into the vacuum from the tip portion of each emitter portion connected with the selected wiring layer. When the dopant concentration of nitrogen in the n-type layers 3*a* to 3*d* is high enough, electrons can be taken out with a high efficiency from the tip portion of each emitter portion by the field emission even at the temperature of the substrate near the room temperature.

Figure 86:
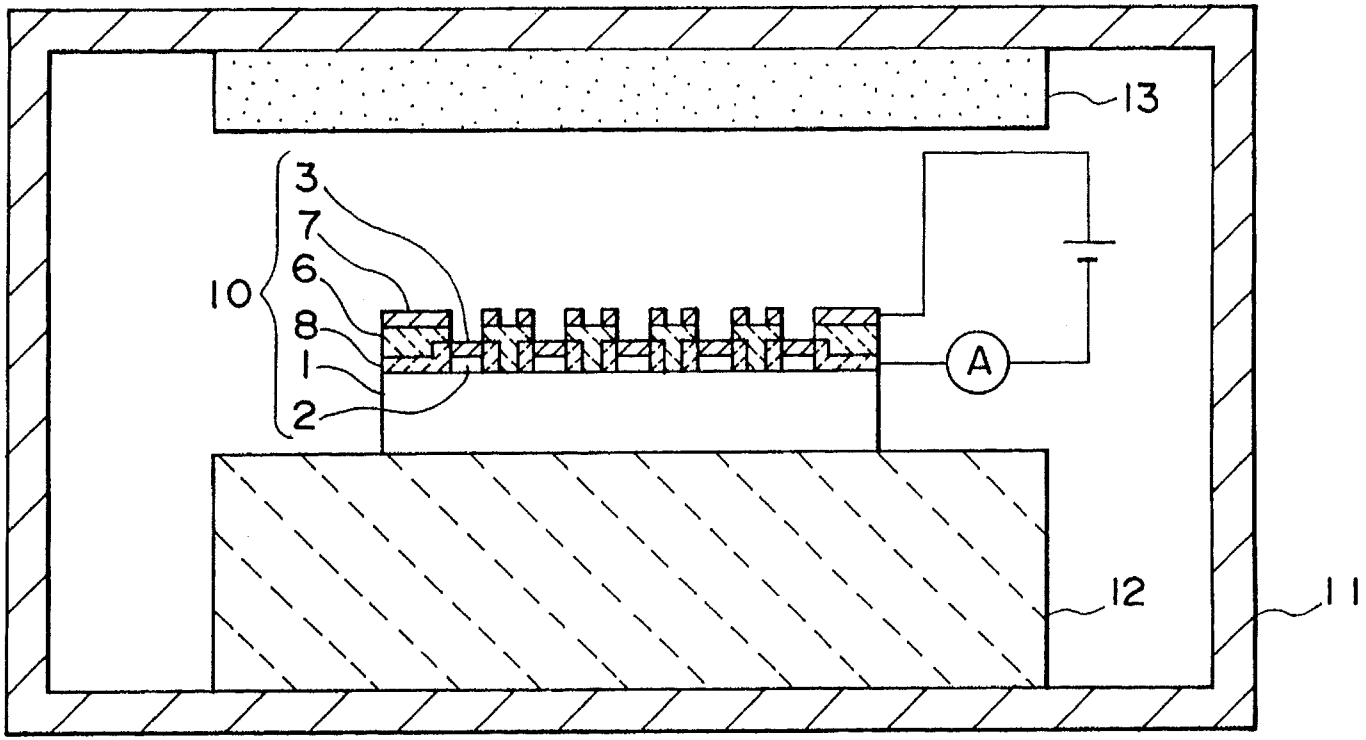
FIG. 86 is a partial cross-sectional view to show the structure of an experimental apparatus of the electron device of FIG. 61.

FIG. 86 is an explanatory drawing to illustrate experiments for the fourth embodiment. An electron device 10 is set inside a vacuum chamber 11, similarly as in the experiments for the second embodiment.

Here, a plurality of emitter portions formed of the i-type layer 2 and n-type layer 3 on the 1 mm-square substrate 1 are arranged at intervals of 5 to 50 μm in a two-dimensional array on the surface of the electron device 10. Each emitter portion is formed substantially in the same manner as in the fourth embodiment except that the dopant concentrations of nitrogen and boron in the n-type layer 3 are changed in a certain range. The anode electrode layers 7 corresponding to the emitter portions are formed as separate from each other. Further, the wiring connecting the power supply and the current meter between the anode electrode layer 7 and the n-type layer may be so arranged that they can be electrically connected with a selected emitter portion by switching.

The heating holder was first activated to set the temperature of the substrate 1 in the range of 20° to 600° C. The power supply was next activated to apply a voltage of 10 V between the electron device 10 and the anode electrode layer 7, generating an electric field. A flow of electrons emitted from the electron device 10 because of the generated electric field was measured by the current meter.

FIG. 95 shows changes of the emission current against the dopant concentrations of nitrogen and boron where the n-type layer 3 is made of single crystal diamond (an epitaxial layer) vapor-phase-synthesized on the substrate 1 made of single crystal diamond.

FIG. 96 shows changes of the emission current against the dopant concentrations of nitrogen and boron where the n-type layer 3 is made of polycrystal diamond vapor-phase-synthesized on the substrate 1 made of silicon.

It is seen from the above results that a sufficient emission current can be attained if the dopant concentration $C_N$ of nitrogen in the n-type layer 3 is not less than $1\times10^{19}$ $cm^{-3}$. It is also understood that a sufficient emission current can be obtained if the dopant concentrations $C_N$, $C_B$ of nitrogen and boron in the n-type layer 3 satisfy the relation of $100C_BC_N \geqq C_B$, more preferably the relation of $10C_B \geqq C_N > C_B$.

It should be noted that the present invention is by no means limited to the above embodiments, but may have various modifications.

For example, the above embodiments showed the diamond semiconductor layer made of a thin film single crystal diamond (epitaxial layer) synthesized in vapor phase, but the same effects can be achieved using artificial bulk single crystal diamond synthesized under a high pressure or thin film polycrystal diamond synthesized in vapor phase. However, taking controllability in producing semiconductor devices into consideration, a preferable arrangement is use of a thin film single crystal synthesized in vapor phase by the CVD method on a single crystal substrate or on a polycrystal substrate having a flatly polished surface.

Also, the above embodiments showed the diamond semiconductor layers of various conduction types formed by the plasma CVD method, but the same operational effects can be achieved by employing the following CVD methods. A first method is to activate gases of raw materials by starting discharge with a dc electric field or ac electric field. A second method is to activate gases of raw materials by heating a thermion radiator. A third method is to grow diamond on an ion-bombarded surface. A fourth method is to excite the gases of raw materials with irradiation of light such as laser, ultraviolet rays, etc. Further, a fifth method is to burn the gases of raw materials.

Further, the above embodiments showed the examples in which the n-type layer contained nitrogen added in diamond by the CVD method, but the same effects can be achieved by forming it in high-pressure synthesis in a high-pressure synthesizing vessel filled with a raw material containing carbon, a raw material containing nitrogen, and a solvent.

Also, the above embodiments showed the examples in which the substrate was the insulating substrate made of single crystal diamond or the semiconductor substrate made of silicon, but the substrate may be an insulating substrate or semiconductor substrate made of another material. Further, the substrate may be made of a metal.

As detailed above, the electron devices of the present invention are so arranged that the emitter portion including the n-type diamond layer at least in the tip region has the bottom area within a 10 μm square and projects from the flat surface in the peripheral region.

Since diamond constituting the n-type diamond layer has a value of electron affinity very close to zero, a difference is fine between the conduction band and the vacuum level. Also, the n-type dopant exists in a high concentration, so that the donor levels are degenerated near the conduction band, making the metal conduction dominant as conduction of electrons. Thus, generating an electric field near the surface of the emitter portion in the temperature range of the room temperature to about 600° C., electrons are emitted with a high efficiency into the vacuum by the field emission with small field strength, even though the tip portion of the emitter portion is not formed in a very fine shape.

Accordingly, the current density in the emitter portion is reduced, thus providing the electron devices increased in emission current and current gain and also increased in withstand current or withstand voltage.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

The basic Japanese Application No. 5-238571 filed on Sep. 24, 1993 is hereby incorporated by reference.

What is claimed is:

1. An electron device comprising:

an i-type diamond layer formed on a substrate; and an n-type diamond layer formed on said i-type diamond layer and having a first surface region and a second surface region;

which are set in a vacuum container;

wherein said first surface region is flatly formed and an emitter portion is formed in said second surface region, said emitter portion having a bottom area 10 or less μm square, formed of said n-type diamond layer, and projecting relative to said first surface region.

2. An electron device according to claim 1, wherein an insulating layer and an electrode layer are successively layered further in said first surface region.

3. An electron device according to claim 1, wherein said n-type diamond layer has a plurality of said second surface regions and a plurality of said emitter portions are formed in a two-dimensional array in said plurality of second surface regions.

4. An electron device according to claim 3, wherein said plurality of emitter portions are formed of at least two said n-type diamond layers arranged as separate from each other.

5. An electron device according to claim 3, wherein said plurality of emitter portions are formed of said n-type diamond layer arranged in unity.

6. An electron device according to claim 1, wherein said emitter portion is formed to have a height being 1/10 or more of a minimum width in said second surface region with respect to said first surface region.

7. An electron device according to claim 1, wherein an n-type dopant in said n-type diamond layer is nitrogen.

8. An electron device according to claim 7, wherein a dopant concentration of nitrogen in said n-type diamond layer is not less than $1\times10^{19}$ $cm^{-3}$.

9. An electron device according to claim 7, wherein a dopant concentration of nitrogen in said n-type diamond layer is greater than a dopant concentration of boron and 100 or less times the dopant concentration of boron.

10. An electron device according to claim 7, wherein a dopant concentration of nitrogen in said n-type diamond layer is greater than a dopant concentration of boron and 10 or less times the dopant concentration of boron.

11. An electron device comprising:

an i-type substrate formed to have a first surface region and a second surface region;

an i-type diamond layer formed in said second surface region;

an n-type diamond layer formed on the i-type diamond layer; and a wiring layer formed in contact with said n-type diamond layer in said first surface region;

which are set in a vacuum container;

wherein said first surface region is flatly formed and an emitter portion is formed in said second surface region, said emitter portion having a bottom area 10 or less μm square, formed of said i-type diamond layer and said n-type diamond layer, and projecting relative to said first surface region.

12. An electron device according to claim 11, wherein said i-type diamond layer is further formed in said first surface region so as to have a flat surface.

13. An electron device according to claim 11, wherein an insulating layer and an electrode layer are successively layered further in said first surface region.

14. An electron device according to claim 11, wherein said n-type diamond layer has a plurality of said second surface regions and a plurality of said emitter portions are formed in a two-dimensional array in said plurality of second surface regions.

15. An electron device according to claim 14, wherein said plurality of emitter portions are formed in contact with at least two said wiring layers, respectively, arranged as separate from each other.

16. An electron device according to claim 14, wherein said plurality of emitter portions are formed in contact with said wiring layer arranged in unity.

17. An electron device according to claim 11, wherein said emitter portion is formed to have a height being 1/10 or more of a minimum width in said second surface region with respect to said first surface region.

18. An electron device according to claim 11, wherein an n-type dopant in said n-type diamond layer is nitrogen.

19. An electron device according to claim 18, wherein a dopant concentration of nitrogen in said n-type diamond layer is not less than $1\times10^{19}$ $cm^{-3}$.

20. An electron device according to claim 18, wherein a dopant concentration of nitrogen in said n-type diamond layer is greater than a dopant concentration of boron and 100 or less times the dopant concentration of boron.

21. An electron device according to claim 18, wherein a dopant concentration of nitrogen in said n-type diamond layer is greater than a dopant concentration of boron and 10 or less times the dopant concentration of boron.

22. An electron device comprising:

an i-type diamond layer formed on a substrate; and at least one n-type diamond layer formed on said i-type diamond layer and having a first surface region and a plurality of second surface regions;

which are set in a vacuum container;

wherein said first surface region is flatly formed and a plurality of emitter portions are formed in said plurality of second surface regions, said emitter portions each having a bottom area 10 or less μm square and formed of said n-type diamond layer, said emitter portions projecting relative to said first surface region and arranged in a two-dimensional array.

23. An electron device according to claim 22, wherein an insulating layer and an electrode layer are successively layered further in said first surface region.

24. An electron device according to claim 22, wherein said plurality of emitter portions are formed of at least two said n-type diamond layers arranged as separate from each other.

25. An electron device according to claim 22, wherein said plurality of emitter portions are formed of said n-type diamond layer arranged in unity.

26. An electron device according to claim 22, wherein said emitter portions are formed to have a height being 1/10 or more of a minimum width in said second surface region with respect to said first surface region.

27. An electron device comprising:

an i-type substrate formed to have a first surface region and a plurality of second surface regions;

a plurality of i-type diamond layers formed in said plurality of respective second surface regions;

a plurality of n-type diamond layers formed on the plurality of respective i-type diamond layers; and at least one wiring layer formed in contact with said n-type diamond layers in said first surface region;

which are set in a vacuum container;

wherein said first surface region is flatly formed and a plurality of emitter portions are formed in said plurality of second surface regions, said emitter portions each having a bottom area 10 or less μm square and formed of said i-type diamond layers and said n-type diamond layers, said emitter portions projecting relative to said first surface region.

28. An electron device according to claim 27, wherein said i-type diamond layers are further formed in said first surface region so as to have a flat surface.

29. An electron device according to claim 27, wherein an insulating layer and an electrode layer are successively layered further in said first surface region.

30. An electron device according to claim 27, wherein said plurality of emitter portions are formed in contact with at least two said wiring layers, respectively, arranged as separate from each other.

31. An electron device according to claim 27, wherein said plurality of emitter portions are formed in contact with said wiring layer arranged in unity.

32. An electron device according to claim 27, wherein said emitter portions are formed to have a height being 1/10 or more of a minimum width in said second surface region with respect to said first surface region.

* * * * *